US011587514B2

(12) United States Patent
Roh et al.

(10) Patent No.: US 11,587,514 B2
(45) Date of Patent: Feb. 21, 2023

(54) DISPLAY DEVICE AND DRIVING METHOD THEREOF

(71) Applicant: Samsung Display Co., Ltd., Yongin-Si (KR)

(72) Inventors: Jin Young Roh, Yongin-si (KR); Hong Soo Kim, Yongin-si (KR); Se Hyuk Park, Yongin-si (KR); Hyo Jin Lee, Yongin-si (KR); Jae Keun Lim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/583,938

(22) Filed: Jan. 25, 2022

(65) Prior Publication Data

US 2022/0328013 A1 Oct. 13, 2022

(30) Foreign Application Priority Data

Apr. 7, 2021 (KR) ..... 10-2021-0045460

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/0278* (2013.01); *G09G 2310/0297* (2013.01); *G09G 2310/061* (2013.01); *G09G 2320/0247* (2013.01)

(58) Field of Classification Search
CPC ..... G09G 2320/0247
See application file for complete search history.

(56) References Cited

U.S. PATENT DOCUMENTS

| | | | | |
|---|---|---|---|---|
| 9,262,974 | B2 | 2/2016 | Lee | |
| 10,638,086 | B2 * | 4/2020 | Ahn | G09G 5/005 |
| 11,367,379 | B1 | 6/2022 | Park et al. | |
| 2005/0195204 | A1 * | 9/2005 | Cheng | G09G 3/3611 345/558 |
| 2008/0238912 | A1 * | 10/2008 | Aoki | G09G 3/3648 345/215 |

(Continued)

FOREIGN PATENT DOCUMENTS

| | | | |
|---|---|---|---|
| KR | 10-0603456 | B1 | 7/2006 |
| KR | 10-1451589 | B1 | 10/2014 |

(Continued)

*Primary Examiner* — Sepehr Azari
(74) *Attorney, Agent, or Firm* — Innovation Counsel LLP

(57) ABSTRACT

Embodiments of the present disclosure relate to a display device and a driving method thereof, and the display device includes a demultiplexer connected to a first data line and transferring a data signal from the first data line to a plurality of second data lines during a data writing period of one frame, a compensator calculating an on-pixel ratio (OPR) using input data in the one frame and generating compensation data corresponding to a calculated OPR, and a data driver supplying the data signal to the first data line using the input data during the data writing period, and supplying a compensation data signal to the first data line using the compensation data in a blank period of the one frame, and the demultiplexer supplies the compensation data signal from the first data line to a second data line during the blank period.

16 Claims, 15 Drawing Sheets

(56) References Cited

U.S. PATENT DOCUMENTS

| | | | | |
|---|---|---|---|---|
| 2016/0124491 | A1* | 5/2016 | An | G06F 1/3265 713/323 |
| 2017/0287419 | A1* | 10/2017 | Noichi | G09G 3/3614 |
| 2018/0083078 | A1* | 3/2018 | Park | H01L 51/102 |
| 2020/0035168 | A1* | 1/2020 | Ueno | G09G 3/3291 |
| 2020/0035169 | A1* | 1/2020 | Sakai | G09G 3/3291 |
| 2021/0043149 | A1* | 2/2021 | Yoo | G09G 3/3291 |

FOREIGN PATENT DOCUMENTS

| | | | |
|---|---|---|---|
| KR | 10-1878176 | B1 | 7/2018 |
| KR | 10-2019-0125008 | A | 11/2019 |
| KR | 10-2022-0129152 | A | 9/2022 |

* cited by examiner

DISPLAY DEVICE AND DRIVING METHOD THEREOF

CROSS-REFERENCE TO RELATED APPLICATION

The application claims priority to and the benefit of Korean Patent Application No. 10-2021-0045460, filed Apr. 7, 2021, which is hereby incorporated by reference for all purposes as if fully set forth herein.

BACKGROUND

1. Field

The present disclosure generally relates to a display device. More particularly, the present disclosure relates to a display device capable of reducing flicker and a driving method thereof.

2. Description of the Related Art

With the development of information technology, the importance of display devices, which are a connection medium between users and information, has been emphasized. In response to this, the use of display devices such as a liquid crystal display device, an organic light emitting display device, and the like has been increasing.

When a display device displays a moving image, it is preferable to display an image at a high frequency in order to smoothly express the motion. However, since there is no motion when the display device displays a still image, there is no problem even if the image is displayed at a low frequency. In addition, when the image is displayed at the low frequency, it is advantageous in terms of power consumption.

However, when a display frequency of the display device is switched from the high frequency to the low frequency, flicker may be visually recognized as the cycle in which luminance decreases is changed.

SUMMARY

A technical problem to be solved by the present disclosure is to provide a display device capable of preventing the visibility of flicker when a display frequency is switched from a high frequency to a low frequency, and a driving method thereof.

In addition, technical problems to be solved by the present disclosure are not limited to the above-mentioned technical problem, and other technical problems not mentioned will be clearly understood by those skilled in the art from the following description.

A display device according to an embodiment of the present disclosure may include a demultiplexer connected to a first data line and transferring a data signal from the first data line to a plurality of second data lines during a data writing period of one frame; a compensator calculating an on-pixel ratio (OPR) using input data in the one frame and generating compensation data corresponding to a calculated OPR; and a data driver supplying the data signal to the first data line using the input data during the data writing period, and supplying a compensation data signal to the first data line using the compensation data in a blank period of the one frame. The demultiplexer may supply the compensation data signal from the first data line to a second data line during the blank period.

According to an embodiment of the present disclosure, the demultiplexer may include a plurality of transistors connected to the first data line, and the plurality of transistors may be turned on when a control signal is supplied from a demultiplexer controller.

According to an embodiment of the present disclosure, the demultiplexer controller may supply the control signal so that the plurality of transistors are repeatedly turned on during the data writing period, and may supply the control signal so that the compensation data signal is supplied to the second data line and the plurality of transistors are turned on at least once during the blank period.

According to an embodiment of the present disclosure, the compensator may include an on-pixel ratio calculator calculating the OPR; and a memory unit storing the compensation data corresponding to the OPR.

According to an embodiment of the present disclosure, the compensation data signal may be stored in a data capacitor connected to each of the second data lines during the data writing period.

According to an embodiment of the present disclosure, the compensation data signal stored in the data capacitor may be supplied to the second data line during the blank period.

According to an embodiment of the present disclosure, the display device may further include a scan driver connected to a plurality of scan lines and supplying a scan signal to the plurality of scan lines during the data writing period.

According to an embodiment of the present disclosure, a period in which the scan signal is supplied may overlap a part of a period in which the data signal is supplied.

A display device according to another embodiment of the present disclosure may include a demultiplexer connected to a first data line and transferring a data signal from the first data line to a plurality of second data lines in response to a control signal supplied during a data writing period of one frame; a data driver supplying the data signal to the first data line during the data writing period; and a demultiplexer controller supplying the control signal for controlling a plurality of transistors included in the demultiplexer. The demultiplexer controller may supply the control signal of a high level for turning off the plurality of transistors during a blank period of the one frame, and during the blank period, last data transferred to a second data line during the data writing period may be stored in a data capacitor connected to each of the second data lines.

According to an embodiment of the present disclosure, the plurality of transistors may be connected to the first data line and the plurality of second data lines, and may be turned on when the control signal of a low level is supplied from the demultiplexer controller.

According to an embodiment of the present disclosure, the demultiplexer controller may supply the control signal so that the plurality of transistors are repeatedly turned on during the data writing period.

According to an embodiment of the present disclosure, the blank period may be a period in which the data signal is not transferred to the second data line.

According to an embodiment of the present disclosure, the display device may further include a scan driver connected to a plurality of scan lines and supplying a scan signal to the plurality of scan lines during the data writing period.

According to an embodiment of the present disclosure, a period in which the scan signal is supplied may overlap a part of a period in which the data signal is supplied.

According to an embodiment of the present disclosure, a driving method of a display device including a demultiplexer, a compensator, and a data driver, may include transferring a data signal from a first data line to a plurality of second data lines during a data writing period of one frame by the demultiplexer connected to the first data line; calculating an on-pixel ratio (OPR) using input data in the one frame and generating compensation data corresponding to a calculated OPR by the compensator; and supplying the data signal to the first data line using the input data during the data writing period and supplying a compensation data signal to the first data line using the compensation data during a blank period of the one frame by the data driver. The demultiplexer may supply the compensation data signal from the first data line to a second data line during the blank period.

According to an embodiment of the present disclosure, the demultiplexer may include a plurality of transistors connected to the first data line, and the transferring the data signal from the first data line to the plurality of second data lines may further include turning on the plurality of transistors when a control signal is supplied from a demultiplexer controller.

According to an embodiment of the present disclosure, the turning on the plurality of transistors when the control signal is supplied may include supplying the control signal so that the plurality of transistors are repeatedly turned on by the demultiplexer controller during the data writing period; and supplying the control signal so that the compensation data signal is supplied to the second data line and the plurality of transistors are turned on at least once during the blank period.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION OF THE ILLUSTRATED EMBODIMENTS

Figure 1:
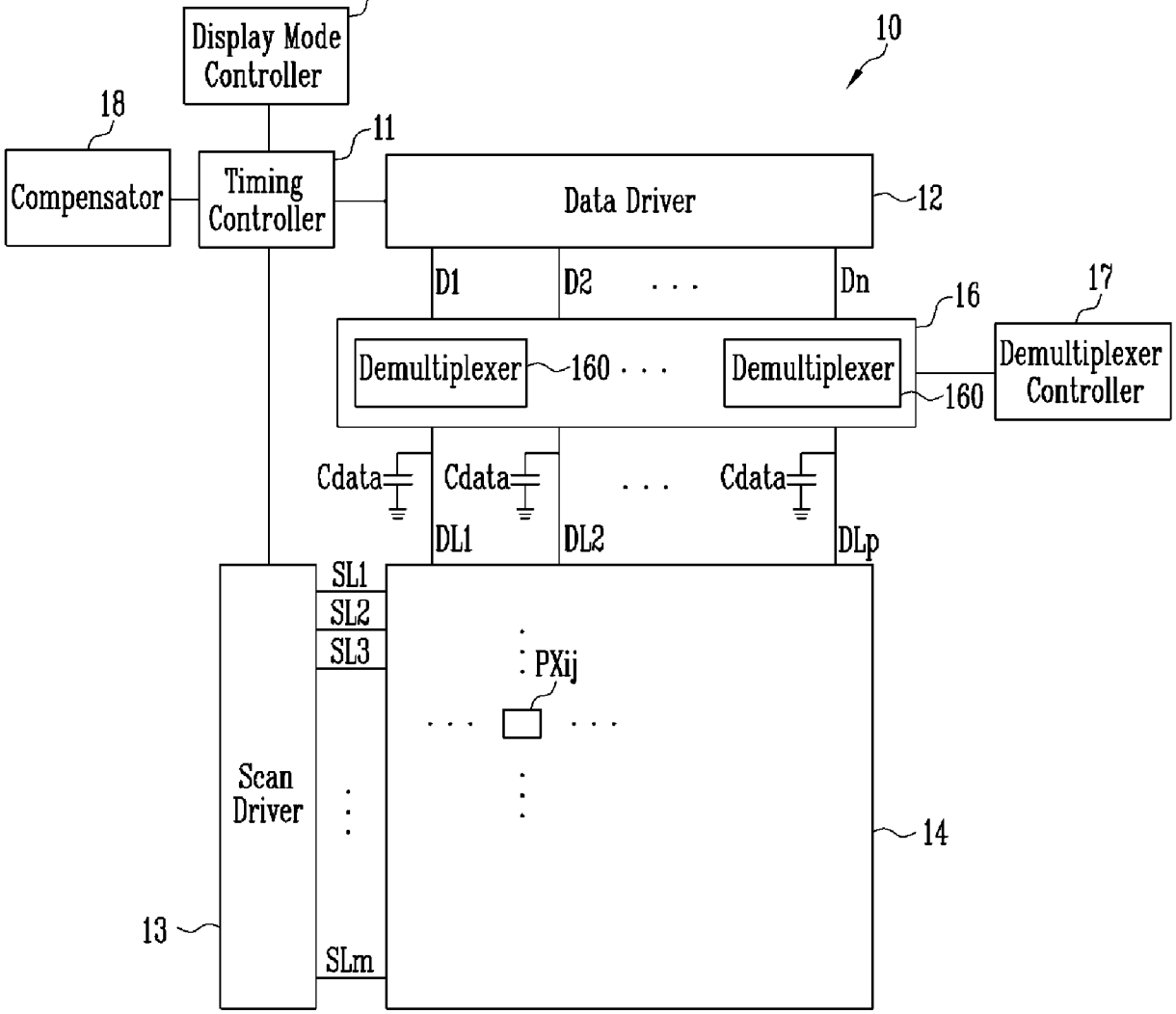
FIG. 1 is a diagram for explaining a display device according to an embodiment of the present disclosure.

Hereinafter, embodiments will be described in detail with reference to the accompanying drawings. The effects and characteristics of the present disclosure and a method of achieving the effects and characteristics will be clear by referring to the embodiments described below in detail together with the accompanying drawings. However, the present disclosure is not limited to the embodiments disclosed herein but may be implemented in various forms. The embodiments are provided by way of example only so that a person of ordinary skilled in the art can fully understand the features in the present disclosure and the scope thereof. Therefore, the present disclosure can be defined by the scope of the appended claims. Like reference numerals generally denote like elements throughout the specification.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. The terms used in this specification are for describing the embodiments and are not intended to limit the embodiments. In this specification, the singular forms are intended to include the plural forms as well, unless the context clearly indicates otherwise.

Hereinafter, a display device according to an embodiment will be described with reference to FIG. 1.

FIG. 1 is a diagram for explaining a display device according to an embodiment of the present disclosure.

Referring to FIG. 1, a display device 10 according to an embodiment of the present disclosure may include a timing controller 11, a data driver 12, a scan driver 13, a pixel unit 14, a display mode controller 15, a demultiplexer block unit 16, a demultiplexer controller 17, a compensator 18, and data capacitors Cdata.

The timing controller 11 may receive an external input signal from an external processor. The external input signal may include a vertical synchronization signal, a horizontal synchronization signal, a data enable signal, RGB data, and the like.

The vertical synchronization signal may include a plurality of pulses, and may indicate that a previous frame period ends and the current frame period begins based on a time point at which each of the pulses occurs. An interval between adjacent pulses of the vertical synchronization signal may correspond to one frame period. The horizontal synchronization signal may include a plurality of pulses, and may indicate that a previous horizontal period ends and a new horizontal period begins based on a time point at which each of the pulses occurs. An interval between adjacent pulses of the horizontal synchronization signal may correspond to one horizontal period. The data enable signal may indicate that the RGB data is supplied in a horizontal period. The RGB data may be supplied in units of pixel rows in horizontal periods in response to the data enable signal. The RGB data corresponding to one frame may be referred to as one input image.

The display mode controller 15 may determine a first display mode or a second display mode based on an input image. The timing controller 11 may control scan signals of the scan driver 13 according to the determined display mode. For example, the timing controller 11 may control the timing at which the scan signals of a turn-on level of the scan driver 13 are supplied according to the determined display mode. In addition, according to an embodiment, the timing controller 11 may control grayscales to be supplied to the data driver 12 according to the determined display mode.

In addition, the display mode controller 15 may be composed of a separate integrated circuit (IC) chip or hardware separate from the timing controller 11. In another embodiment, the display mode controller 15 may be composed of a single IC or hardware integrated with the timing controller 11. In still another embodiment, the display mode controller 15 may be composed of software of the timing controller 11.

The data driver 12 may provide data signals (or data voltages) corresponding to grayscales of the input image to pixels. For example, the data driver 12 may sample the grayscales using a clock signal and apply the data signals corresponding to the grayscales to first data lines D1 to Dn in units of scan lines, where n may be an integer greater than 0.

The scan driver 13 may receive a clock signal, a scan start signal, and the like from the timing controller 11 and generate the scan signals to be provided to scan lines SL1, SL2, SL3, . . . , and SLm, where m may be an integer greater than 0.

The pixel unit 14 may include dots. Each dot may include at least two pixels of different colors. The dot may be a display unit for displaying a combined color. For example, the external processor may provide the grayscales in units of dots. Each pixel PXij may be connected to a corresponding second data line DL1, DL2, . . . , or DLp and a corresponding scan line SL1, SL2, SL3, . . . , or SLm, where i and j may be integers greater than 0. For example, the pixel PXij may mean a pixel in which a scan transistor is connected to an i-th scan line and a j-th second data line. However, hereinafter, PX1, PX2, PX5, and PX6 shown in FIG. 2 will be referred to as first pixels, and PX3, PX4, PX7, and PX8 shown in FIG. 2 will be referred to as second pixels.

Although not shown, the display device 10 may further include an emission driver. The emission driver may receive a clock signal, an emission stop signal, and the like from the timing controller 11 and generate emission signals to be provided to emission lines.

For example, the emission driver may include emission stages connected to the emission lines. The emission stages may be configured in the form of a shift register. Specifically, a first emission stage may generate an emission signal of a turn-off level based on the emission stop signal of a turn-off level, and the remaining emission stages may sequentially generate emission signals of the turn-off level based on the emission signal of the turn-off level of a previous emission stage.

When the display device 10 includes the emission driver described above, each pixel PXij may further include a transistor connected to an emission line. The transistor may be turned off during a data writing period of each pixel PXij to prevent the pixel PXij from emitting light.

The demultiplexer block unit 16 may include a plurality of demultiplexers 160. In other words, the demultiplexer block unit 16 may include the same number of demultiplexers 160 as the first data lines D1 to Dn. Each demultiplexer 160 may be connected to one of the first data lines D1 to Dn. In addition, each of the demultiplexers 160 may be connected to L second data lines (hereinafter, it is assumed that L is 2). The demultiplexer 160 may supply a data signal supplied during the data writing period to the L second data lines.

In this way, when each data signal supplied to the first data lines D1 to Dn is supplied to the L second data lines, the number of output lines included in the data driver 12 can be reduced. In addition, the number of data integrated circuits included in the data driver 12 can be reduced. That is, manufacturing cost can be reduced by supplying the data signal supplied to one first data line to the L second data lines DL using the demultiplexer 160.

The demultiplexer controller 17 may supply a control signal to each of the demultiplexers 160 during the data writing period so that the data signal supplied to the first data lines D1 to Dn is divided and supplied to the second data lines DL1 to DLp. Here, the control signal supplied from the demultiplexer controller 17 may be sequentially supplied so as not to overlap during the data writing period. Meanwhile, although the demultiplexer controller 17 is shown to be installed outside the timing controller 11, according to an embodiment, the demultiplexer controller 17 may be installed inside the timing controller 11.

The data capacitors Cdata may be installed for each of the second data lines DL1 to DLp. These data capacitors Cdata may temporarily store the data signal supplied to the second data lines DL1 to DLp, and may supply the stored data signal to the pixel PXij. Here, as a data capacitor Cdata, a parasitic capacitor equivalently formed on each of the second data lines DL1 to DLp may be used. In addition, an external capacitor additionally installed for each of the second data lines DL1 to DLp may be used as the data capacitor Cdata.

The compensator 18 may calculate an on-pixel ratio using the RGB data of one frame. Also, the compensator 18 may generate compensation data corresponding to the calculated on-pixel ratio. The compensation data generated by the compensator 18 may be supplied to the data driver 12 via the timing controller 11. The data driver 12 may supply a compensation data signal corresponding to the compensation data to the first data lines D1 to Dn during a blank period among one frame period. The compensation data signal supplied to the first data lines D1 to Dn may be supplied to the second data lines DL1 to DLp via the demultiplexers 160. Accordingly, a voltage corresponding to the compensation data signal may be stored in the data capacitor Cdata.

Figure 2:
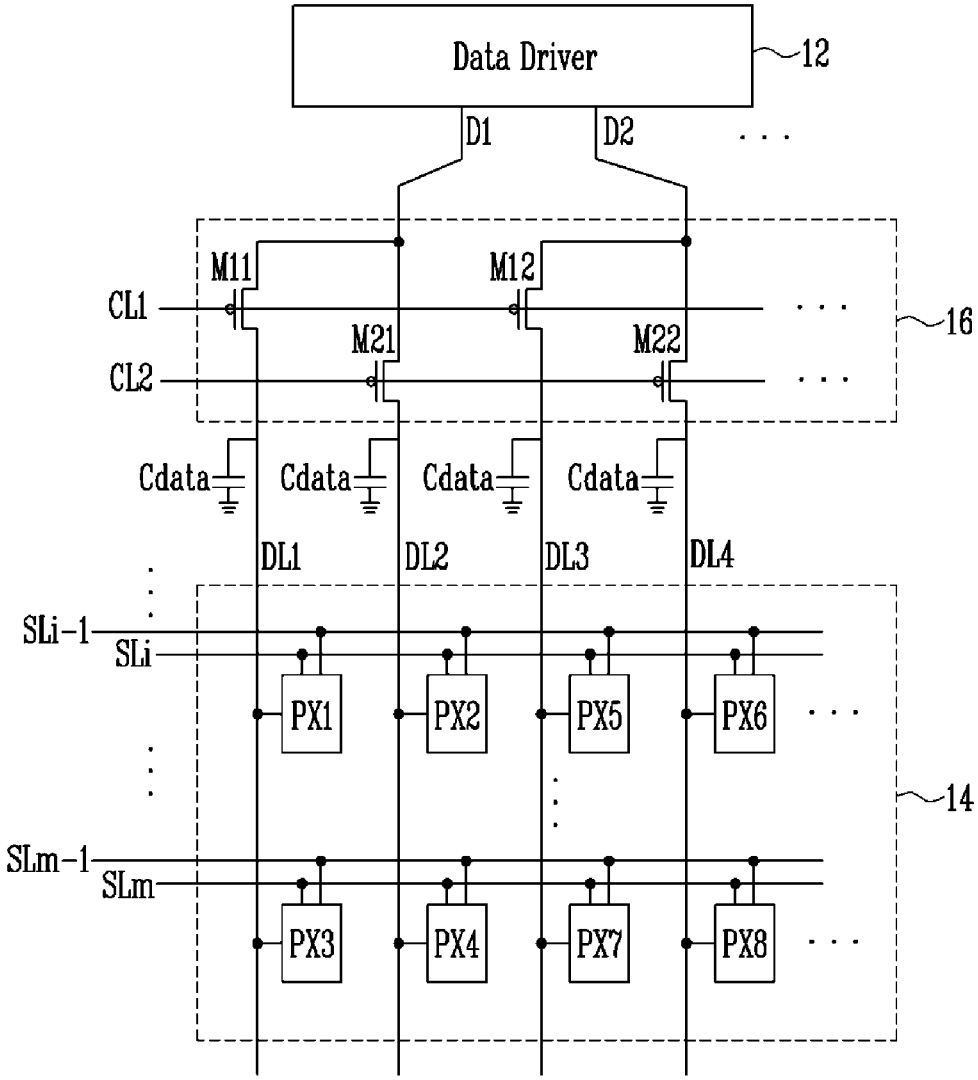
FIG. 2 is a diagram for explaining a pixel unit and a demultiplexer block unit according to an embodiment of the present disclosure.
Figure 3:
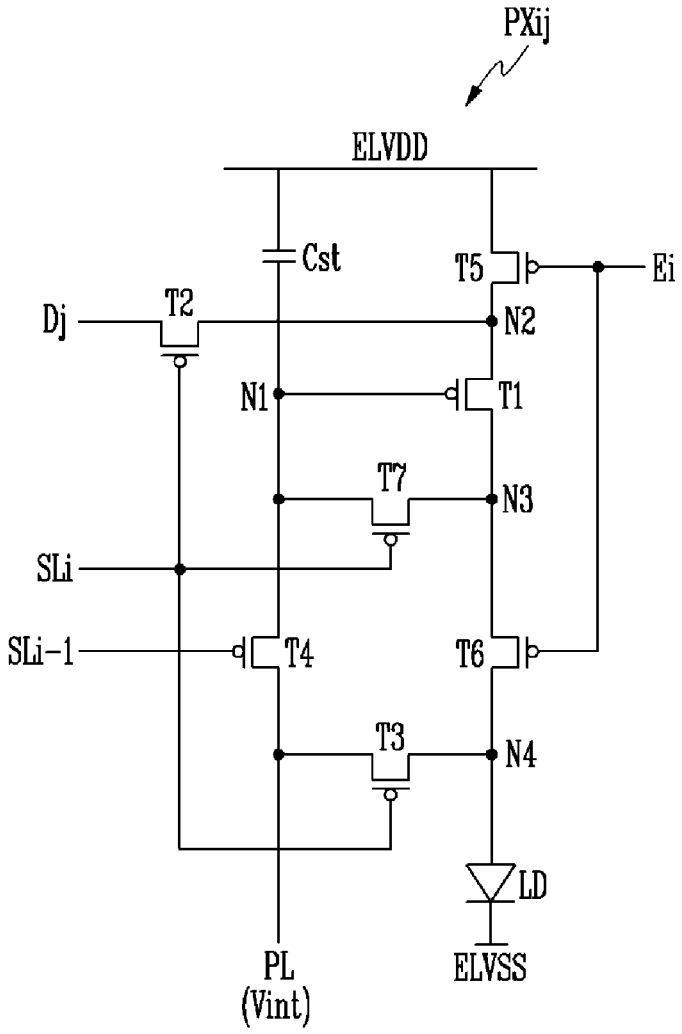
FIG. 3 is a diagram for explaining a pixel according to an embodiment of the present disclosure.

FIG. 2 is a diagram for explaining a pixel unit and a demultiplexer block unit according to an embodiment of the present disclosure. FIG. 3 is a diagram for explaining a pixel according to an embodiment of the present disclosure.

Referring to FIG. 2, the demultiplexer block unit 16 may include first transistors M11 and M12 and second transistors M21 and M22. Gate electrodes of the first transistors M11 and M12 may be connected to a first control line CL1, first electrodes may be connected to first data lines D1 and D2, and second electrodes may be connected to second data lines DL1 and DL3. Gate electrodes of the second transistors M21 and M22 may be connected to a second control line CL2, first electrodes may be connected to the first data lines D1 and D2, and second electrodes may be connected to second data lines DL2 and DL4.

A period in which the first transistors M11 and M12 are turned on and a period in which the second transistors M21 and M22 are turned on may not overlap with each other. The timing controller 11 may provide control signals of a turn-on level to first and second control lines CL1 and CL2 so that the first transistors M11 and M12 and the second transistors M21 and M22 are alternately turned on.

In this case, the number of first transistors M11 and M12 and the number of second transistors M21 and M22 may be the same. Also, the number of second data lines DL1 and DL3 and the number of second data lines DL2 and DL4 may be the same. The second data lines DL1 and DL3 and the second data lines DL2 and DL4 may be alternately arranged with each other.

The pixel unit 14 may include arranged pixels PX1, PX2, PX3, PX4, PX5, PX6, PX7, and PX8. The first pixels PX1, PX2, PX5, and PX6 may be connected to an (i−1)th scan line SLi−1 and an i-th scan line SLi. Each of the first pixels PX1, PX2, PX5, and PX6 may be connected to different second data lines DL1, DL2, DL3, and DL4, respectively.

In addition, the second pixels PX3, PX4, PX7, and PX8 may be connected to a (m−1)th scan line SLm−1 and a m-th scan line SLm. Each of the second pixels PX3, PX4, PX7, and PX8 may be connected to different second data lines DL1, DL2, DL3, and DL4, respectively.

Hereinafter, a pixel according to an embodiment of the present disclosure will be described with reference to FIG. 3.

FIG. 3 is a diagram for explaining a pixel according to an embodiment of the present disclosure.

In FIG. 3, for convenience of explanation, a pixel PXij positioned on an i-th horizontal line and connected to a j-th first data line Dj is shown.

Referring to FIGS. 1, 2, and 3, the pixel PXij may include a light emitting element LD, transistors T1, T2, T3, T4, T5, T6, and T7, and a storage capacitor Cst.

A first electrode (anode electrode or cathode electrode) of the light emitting element LD may be connected to a fourth node N4, and a second electrode (cathode electrode or anode electrode) may be connected to a second driving power line ELVSS. The light emitting element LD may generate light of a predetermined luminance in response to the amount of current supplied from a first transistor T1.

In an embodiment, the light emitting element LD may be an organic light emitting diode including an organic light emitting layer. In another embodiment, the light emitting element LD may be an inorganic light emitting element formed of an inorganic material. Alternatively, the light emitting element LD may have a form in which inorganic light emitting elements are connected in parallel and/or in series between the second driving power line ELVSS and the fourth node N4.

A first electrode of the first transistor T1 (or a driving transistor) may be connected to a second node N2 and a second electrode may be connected to a third node N3. A gate electrode of the first transistor T1 may be connected to a first node N1. The first transistor T1 may control a driving current flowing from a first driving power line ELVDD to the second driving power line ELVSS via the light emitting element LD in response to a voltage of the first node N1. A voltage of the first driving power line ELVDD may be set to a higher voltage than that of the second driving power line ELVSS.

A second transistor T2 may be connected between the j-th first data line Dj and the second node N2. A gate electrode of the second transistor T2 may be connected to the i-th scan line SLi. The second transistor T2 may be turned on by a gate-on level of the scan signal supplied to the i-th scan line SLi to electrically connect the j-th first data line Dj and the second node N2.

A third transistor T3 may be connected between the first electrode of the light emitting element LD (that is, the fourth node N4) and a power line PL supplying an initialization voltage Vint. A gate electrode of the third transistor T3 may be connected to the i-th scan line SLi. The third transistor T3 may be turned on by the gate-on level of the scan signal supplied to the i-th scan line SLi to supply a voltage of the initialization voltage Vint to the first electrode of the light emitting element LD (that is, the fourth node N4).

A fourth transistor T4 may be connected between the first node N1 and the power line PL. A gate electrode of the fourth transistor T4 may be turned on by the gate-on level of the scan signal supplied to the (i−1)th scan line SLi−1 to supply the voltage of the initialization voltage Vint to the first node N1.

A fifth transistor T5 may be connected between the first driving power line ELVDD and the second node N2. A gate electrode of the fifth transistor T5 may be connected to an i-th emission control line Ei. The fifth transistor T5 may be turned on by a gate-on level of an emission control signal supplied to the i-th emission control line Ei.

A sixth transistor T6 may be connected between the second electrode of the first transistor T1 (that is, the third node N3) and the first electrode of the light emitting element LD (that is, the fourth node N4). A gate electrode of the sixth transistor T6 may be connected to the i-th emission control line Ei. The sixth transistor T6 may be turned on by the gate-on level of the emission control signal supplied to the i-th emission control line Ei. Accordingly, the fifth transistor T5 and the sixth transistor T6 may be controlled at the same time.

A seventh transistor T7 may be connected between the second electrode of the first transistor T1 (that is, the third node N3) and the first node N1. A gate electrode of the seventh transistor T7 may be connected to the i-th scan line SLi. The seventh transistor T7 may be turned on by the gate-on level of the scan signal supplied to the i-th scan line SLi to electrically connect the second electrode of the first transistor T1 and the first node N1. When the seventh transistor T7 is turned on, the first transistor T1 may be connected in the form of a diode.

The storage capacitor Cst may be connected between the first driving power line ELVDD and the first node N1.

Hereinafter, a stage included in the scan driver according to an embodiment of the present disclosure will be described with reference to FIG. 4.

Figure 4:
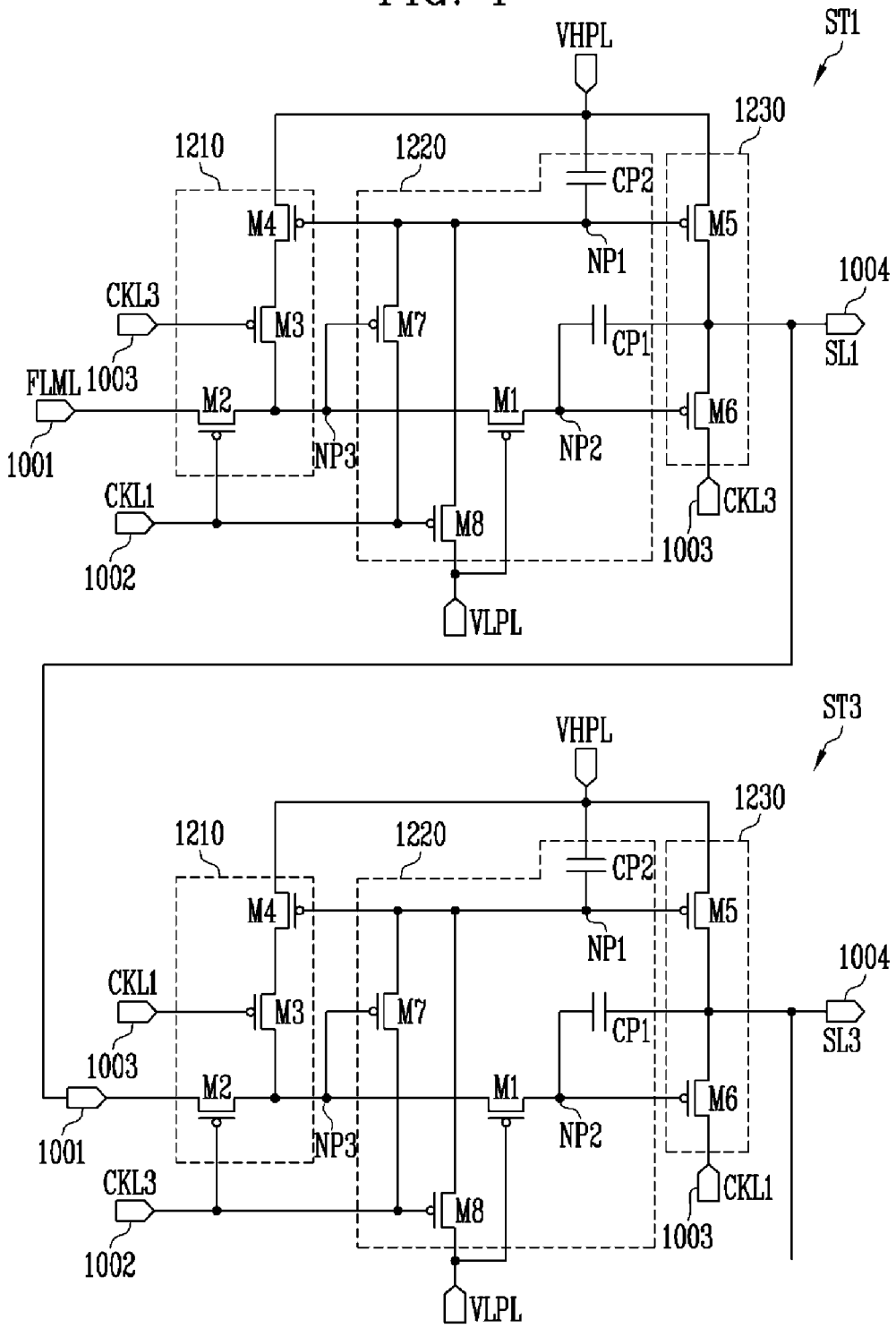
FIG. 4 is a diagram for explaining a stage according to an embodiment of the present disclosure.

FIG. 4 is a diagram for explaining a stage included in the scan driver according to an embodiment of the present disclosure.

In FIG. 4, for convenience of explanation, a first start stage ST1 and a first stage ST3 included in the scan driver are shown. Referring to FIG. 4, the first start stage ST1 may include a first driver 1210, a second driver 1220, and an output unit (buffer) 1230.

The output unit 1230 may control a voltage supplied to an output terminal 1004 in response to voltages of a node NP1 and a node NP2. To this end, the output unit 1230 may include a transistor M5 and a transistor M6.

The transistor M5 may be positioned between a power line VHPL and the output terminal 1004, and a gate electrode of the transistor M5 may be connected to the node NP1. The transistor M5 may control the connection between the power line VHPL and the output terminal 1004 in response to a voltage applied to the node NP1.

The transistor M6 may be positioned between the output terminal 1004 and a third input terminal 1003, and a gate electrode of the transistor M6 may be connected to the node NP2. The transistor M6 may control the connection between the output terminal 1004 and the third input terminal 1003 in response to a voltage applied to the node NP2. The output unit 1230 may be driven as a buffer. Additionally, the transistor M5 and the transistor M6 may be composed of a plurality of transistors connected in parallel.

The first driver 1210 may control a voltage of the node NP3 in response to signals supplied to first, second, and third input terminals 1001, 1002, and 1003. To this end, the first driver 1210 may include transistors M2, M3, and M4.

The transistor M2 may be positioned between the first input terminal 1001 and the node NP3, and a gate electrode may be connected to the second input terminal 1002. The transistor M2 may control the connection between the first input terminal 1001 and the node NP3 in response to a signal supplied to the second input terminal 1002.

The transistor M3 and the transistor M4 may be connected in series between the node NP3 and the power line VHPL. The transistor M3 may be positioned between the transistor M4 and the node NP3, and a gate electrode may be connected to the third input terminal 1003. The transistor M3 may control the connection between the transistor M4 and the node NP3 in response to a signal supplied to the third input terminal 1003.

Transistor M4 may be positioned between transistor M3 and power line VHPL, and a gate electrode may be connected to the node NP1. The transistor M4 may control the connection between the transistor M3 and the power line VHPL in response to a voltage of the node NP1.

The second driver 1220 may control the voltage of the node NP1 in response to voltages of the second input terminal 1002 and the node NP3. To this end, the second driver 1220 may include a transistor M1, a transistor M7, a transistor M8, a capacitor CP1, and a capacitor CP2.

The capacitor CP1 may be connected between the node NP2 and the output terminal 1004. The capacitor CP1 may charge a voltage corresponding to turn-on and turn-off of the transistor M6.

The capacitor CP2 may be connected between the node NP1 and the power line VHPL. The capacitor CP2 may charge a voltage applied to the node NP1.

The transistor M7 may be positioned between the node NP1 and the second input terminal 1002, and a gate electrode may be connected to the node NP3. The transistor M7 may control the connection between the node NP1 and the second input terminal 1002 in response to the voltage of the node NP3.

The transistor M8 may be positioned between the node NP1 and the power line VLPL, and a gate electrode may be connected to the second input terminal 1002. The transistor M8 may control the connection between the node NP1 and the power line VLPL in response to a signal from the second input terminal 1002.

The transistor M1 may be positioned between the node NP3 and the node NP2, and a gate electrode may be connected to the power line VLPL. The transistor M1 may maintain the electrical connection between the node NP3 and the node NP2 while maintaining a turned-on state. Additionally, the transistor M1 may limit the width of voltage drop at the node NP3 in response to a voltage of the node NP2. Specifically, even if the voltage of the node NP2 falls to a voltage lower than a voltage of the power line VLPL, the voltage of the node NP3 may not be lower than a voltage obtained by subtracting a threshold voltage of the transistor M1 from the voltage of the power line VLPL.

Figure 5:
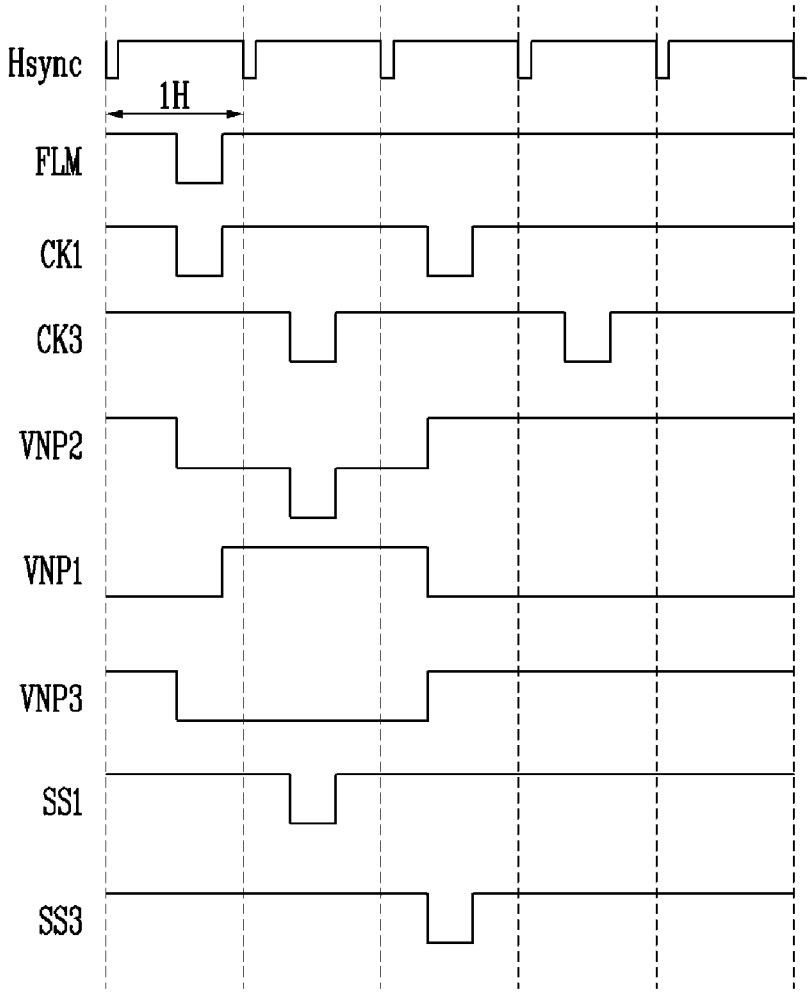
FIG. 5 is a diagram for explaining a driving method of a scan driver according to an embodiment of the present disclosure.

Hereinafter, a driving method of the scan driver according to an embodiment of the present disclosure will be described with reference to FIG. 5. FIG. 5 is a diagram for explaining a driving method of a scan driver according to an embodiment of the present disclosure. In FIG. 5, for convenience of explanation, an operation process will be described using the first start stage ST1.

Referring to FIG. 5, a first clock signal CK1 and a first clock signal CK3 may have a cycle of two horizontal periods 2H, and may be supplied in different horizontal periods. In other words, the first clock signal CK3 may be set as a signal shifted by a half cycle (that is, one horizontal period) from the first clock signal CK1. In addition, a scan start signal FLM supplied to the first input terminal 1001 may be supplied in synchronization with the first clock signal CK1 supplied to the second input terminal 1002.

The expression that specific signals are supplied may mean that the specific signals have a turn-on level (here, a logic low level). The expression that the supply of specific signals is stopped may mean that the specific signals have a turn-off level (here, a logic high level).

Additionally, when the scan start signal FLM is supplied, the first input terminal 1001 may be set to a voltage of the logic low level. When the scan start signal FLM is not supplied, the first input terminal 1001 may be set to a voltage of the logic high level. In addition, when a clock signal is supplied to the second input terminal 1002 and the third input terminal 1003, the second input terminal 1002 and the third input terminal 1003 may be set to the voltage of the logic low level. When the clock signal is not supplied to the second input terminal 1002 and the third input terminal 1003, the second input terminal 1002 and the third input terminal 1003 may be set to the voltage of the logic high level.

To describe the operation process in detail, first, the scan start signal FLM may be supplied in synchronization with the first clock signal CK1.

When the first clock signal CK1 is supplied, the transistor M2 and the transistor M8 may be turned on. When the transistor M2 is turned on, the first input terminal 1001 and the node NP3 may be electrically connected. Here, since the transistor M1 is set to a turned-on state in most of the period, the node NP2 may maintain the electrical connection with the node NP3.

When the first input terminal 1001 and the node NP3 are electrically connected, voltages VNP2 and VNP3 of the node NP3 and the node NP2 may be set to a low level by the scan start signal FLM supplied to the first input terminal 1001. When the voltages VNP2 and VNP3 of the node NP3 and the node NP2 are set to the low level, the transistor M6 and the transistor M7 may be turned on.

When the transistor M6 is turned on, the third input terminal 1003 and the output terminal 1004 may be electrically connected. Here, the third input terminal 1003 may be set to a voltage of a high level (that is, the first clock signal CLK3 is not supplied), and accordingly, the voltage of the high level may also be output to the output terminal 1004. When the transistor M7 is turned on, the second input terminal 1002 and the node NP1 may be electrically connected. A voltage VNP1 of the node NP1 may be set to the low level according to the first clock signal CK1 supplied to the second input terminal 1002.

Additionally, when the first clock signal CK1 is supplied, the transistor M8 may be turned on. When the transistor M8 is turned on, the voltage of the power line VLPL may be supplied to the node NP1. Here, the voltage of the power line VLPL may be set to the same (or similar) voltage as the low level of the first clock signal CK1. Accordingly, the node NP1 may stably maintain a voltage of the low level.

When the node NP1 is set to the voltage of the low level, the transistor M4 and the transistor M5 may be turned on. When the transistor M4 is turned on, the power line VHPL and the transistor M3 may be electrically connected. Here, since the transistor M3 is set to a turned-off state, the node NP3 may stably maintain the voltage of the low level even when the transistor M4 is turned on.

In addition, when the transistor M5 is turned on, the voltage of the power line VHPL may be supplied to the output terminal 1004. Here, the voltage of the power line VHPL may be set to the same (or similar) voltage as the voltage of the high level supplied to the third input terminal 1003. Accordingly, the output terminal 1004 may stably maintain the voltage of the high level.

Thereafter, the supply of the scan start signal FLM and the first clock signal CK1 may be stopped. When the supply of the first clock signal CK1 is stopped, the transistor M2 and the transistor M8 may be turned off. In this case, the transistor M6 and the transistor M7 may maintain the turned-on state in response to the voltage stored in the capacitor CP1. That is, the node NP2 and the node NP3 may maintain the voltage of the low level by the voltage stored in the capacitor CP1.

When the transistor M6 maintains the turned-on state, the output terminal 1004 may maintain the electrical connection with the third input terminal 1003. When the transistor M7 maintains the turned-on state, the node NP1 may maintain the electrical connection with the second input terminal 1002. Here, a voltage of the second input terminal 1002 may be set to the voltage of the high level as the supply of the first clock signal CK1 is stopped. Accordingly, the voltage VNP1 of the node NP1 may be also set to the voltage of the high level. When the voltage of the high level is supplied to the node NP1, the transistor M4 and the transistor M5 may be turned off.

Thereafter, the first clock signal CK3 may be supplied to the third input terminal 1003. In this case, since the transistor M6 is set to the turned-on state, the first clock signal CK3 supplied to the third input terminal 1003 may be supplied to the output terminal 1004. In this case, the output terminal 1004 may output the first clock signal CK3 as a scan signal SS1 of the turn-on level to a first scan line SL1.

Meanwhile, when the first clock signal CK3 is supplied to the output terminal 1004, the voltage of the node NP2 may be lowered to a voltage lower than that of the power line VLPL due to the coupling of the capacitor CP1. Accordingly, the transistor M6 may stably maintain the turned-on state.

On the other hand, even if the voltage of the node NP2 is lowered, the node NP3 may approximately maintain the voltage of the power line VLPL (for example, a voltage obtained by subtracting the threshold voltage of the transistor M1 from the voltage of the power line VLPL) by the transistor M1.

After a first scan signal SSL1 of the turn-on level is output to the first scan line SL1, the supply of the first clock signal CK3 may be stopped. When the supply of the first clock signal CK3 is stopped, the output terminal 1004 may output the voltage of the high level. Further, the voltage VNP2 of the node NP2 may increase to approximately the voltage of the power line VLPL in response to the voltage of the high level of the output terminal 1004.

Thereafter, the first clock signal CK1 may be supplied. When the first clock signal CK1 is supplied, the transistor M2 and the transistor M8 may be turned on. When the transistor M2 is turned on, the first input terminal 1001 and the node NP3 may be electrically connected. At this time, the scan start signal FLM may not be supplied to the first input terminal 1001. Accordingly, the node NP3 may be set to the voltage of the high level. Therefore, the voltage of the high level may be supplied to the node NP3 and the node NP2. Accordingly, the transistor M6 and the transistor M7 may be turned off.

When the transistor M8 is turned on, the voltage of the power line VLPL may be supplied to the node NP1. Accordingly, the transistor M4 and the transistor M5 may be turned on. When the transistor M5 is turned on, the voltage of the power line VHPL may be supplied to the output terminal 1004. Thereafter, the transistor M4 and the transistor M5 may maintain the turned-on state in response to the voltage charged in the capacitor CP2. Accordingly, the output terminal 1004 may stably receive the voltage of the power line VHPL.

Additionally, when the first clock signal CK3 is supplied, the transistor M3 may be turned on. At this time, since the transistor M4 is set to the turned-on state, the voltage of the power line VHPL may be supplied to the node NP3 and the node NP2. In this case, the transistor M6 and the transistor M7 may stably maintain the turned-off state.

The first stage ST3 may receive an output signal (that is, the scan signal) of the first start stage ST1 so as to be synchronized with the first clock signal CK3. In this case, the first stage ST3 may output a first scan signal SS3 of the turn-on level to a first scan line SL3 to be synchronized with the first clock signal CK1. The first stages ST1, ST3, . . . may sequentially output the scan signal of the turn-on level to the first scan lines SL1, SL3, . . . while repeating the above-described process.

Figure 6:
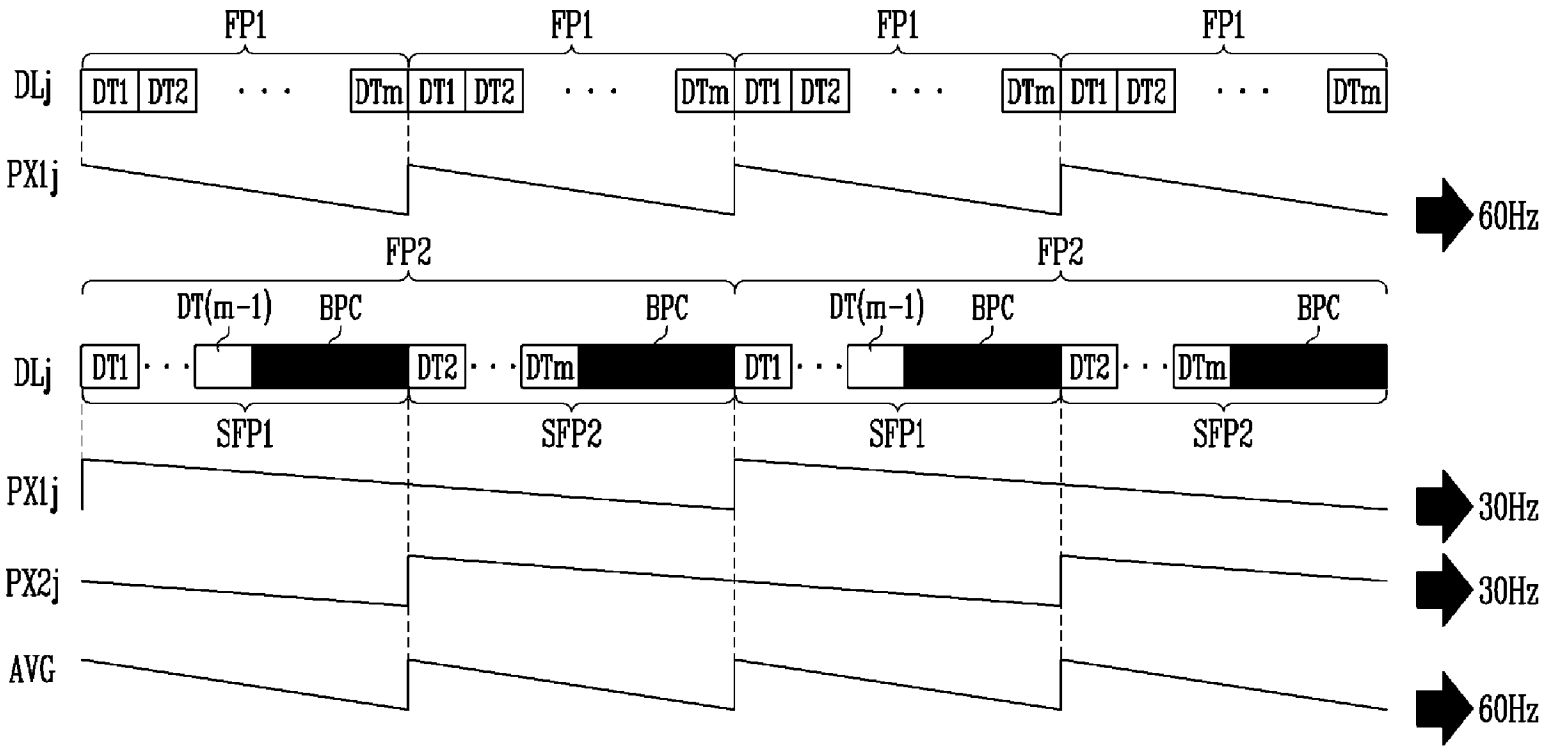
FIG. 6 is a diagram for explaining a first frame period and a second frame period according to an embodiment of the present disclosure.

FIG. 6 is a diagram for explaining a first frame period and a second frame period according to an embodiment of the present disclosure.

The display device 10 may operate in the first display mode including a plurality of first frame periods FP1 or the second display mode including a plurality of second frame periods FP2. A second frame period FP2 may be longer than a first frame period FP1. For example, the second frame period FP2 may be an integer multiple of the first frame period FP1. Specifically, the second frame period FP2 may be 2p times the first frame period FP1, where p may be an integer greater than 0. In the embodiment of FIG. 6, the second frame period FP2 is twice the first frame period FP1.

The first display mode may be suitable for displaying a moving image by displaying input images (frames) at a high frequency. The second display mode may be suitable for displaying a still image by displaying input images at a low frequency. When a still image is detected while displaying a moving image, the display device 10 may switch from the first display mode to the second display mode. Also, when a moving image is detected while displaying a still image, the display device 10 may switch from the second display mode to the first display mode.

Referring to FIG. 6, for convenience of explanation, the description will be made based on the j-th second data line DLj and pixels PX1*j* and PX2*j*. For example, the pixel PX1*j* may be connected to the j-th second data line and the first scan line SL1. The pixel PX1*j* may belong to a first dot. For example, the pixel PX2*j* may be connected to the j-th second data line and a second scan line SL2. The second pixel PX2*j* may belong to a second dot.

In each first frame period FP1, the data driver 12 may sequentially apply data voltages corresponding to the scan lines to the second data line through the first data line. For example, the data driver 12 may sequentially apply data voltages DT1, DT2, . . . , and DTm to the j-th second data line DLj. Assuming that the first frame period FP1 is 1/60 second, a first data voltage DT1 may be supplied to the pixel PX1*j* at 60 Hz. Accordingly, the pixel PX1*j* may emit light with the highest luminance when the first data voltage DT1 is applied, and then the luminance may gradually decrease due to a leakage current. Referring to FIG. 6, a luminance waveform of the pixel PX1*j* corresponding to the plurality of first frame periods FP1 is shown as an example.

Each second frame period FP2 may include a first sub-frame period SFP1 and a second sub-frame period SFP2. The lengths of the first sub-frame period SFP1 and the second sub-frame period SFP2 may be the same. For example, assuming that the second frame period FP2 is 1/30 second, each of the first sub-frame period SFP1 and the second sub-frame period SFP2 may be 1/60 second.

In addition, each of the first sub-frame period SFP1 and the second sub-frame period SFP2 may include a blank period BPC. The blank period BPC may be a remaining period after the data driver 12 finishes supplying the data voltages in each of the first sub-frame period SFP1 and the second sub-frame period SFP2. During the blank period BPC, all or at least a part of the data driver 12 (gamma amp, digital logic) may be powered off to reduce power consumption.

In each first sub-frame period SFP1, the data driver 12 may sequentially apply the data voltages corresponding to first dots to the second data line through the first data line. For example, the data driver 12 may sequentially apply data voltages DT1, DT3, . . . , and DT(m−1) to the j-th second data line DLj.

Accordingly, the first data voltage DT1 may be supplied to the pixel PX1*j* at 30 Hz. Accordingly, the pixel PX1*j* may emit light with the highest luminance when the first data voltage DT1 is applied, and then the luminance may gradually decrease due to the leakage current.

Referring to FIG. 6, a luminance waveform of the pixel PX1*j* corresponding to a plurality of second frame periods FP2 is shown as an example. Also, a second data voltage DT2 may be applied to the pixel PX2*j* at 30 Hz. Accordingly, the pixel PX2*j* may emit light with the highest luminance when the second data voltage DT2 is applied, and then the luminance may gradually decrease due to the leakage current. Referring to FIG. 6, a luminance waveform of the pixel PX2*j* corresponding to the plurality of second frame periods FP2 is shown as an example.

In this case, since the pixel PX1*j* and the pixel PX2*j* are positioned adjacent to each other, in general, the first data voltage DT1 and the second data voltage DT2 may be substantially the same or similar in the input image.

Since a time point at which the pixel PX1*j* has the highest luminance and a time point at which the pixel PX2*j* has the highest luminance are alternately positioned, a user may recognize an average luminance waveform AVG of the pixel PX1*j* and the pixel PX2*j* as 60 Hz. Accordingly, even when the first display mode and the second display mode are switched, the visibility of flicker due to a difference in luminance waveform can be prevented.

Figure 7:
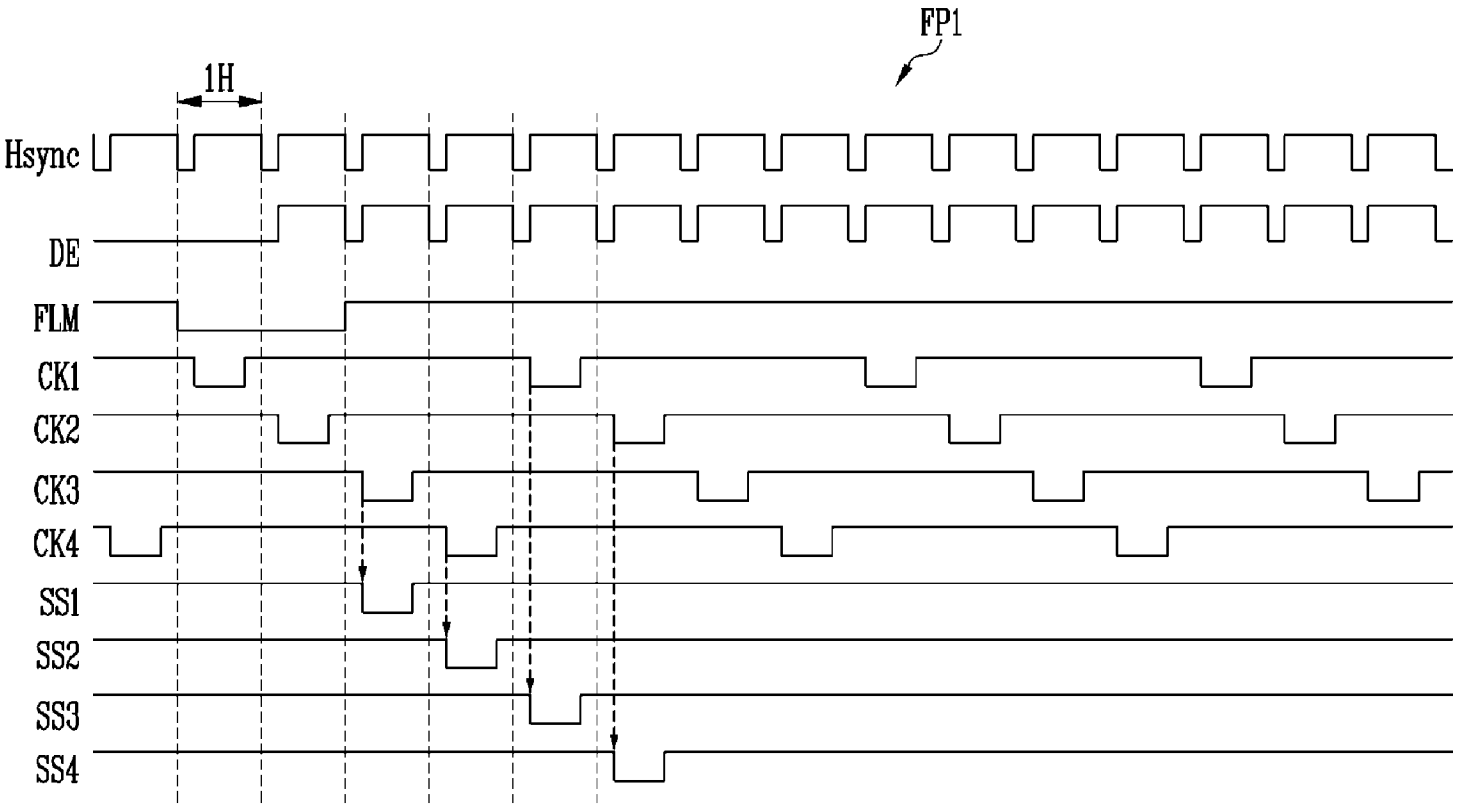
FIG. 7 is a diagram for explaining control signals in a first frame period according to an embodiment of the present disclosure.

FIG. 7 shows control signals in the first frame period FP1 according to an embodiment of the present disclosure as an example.

During the first frame period FP1, the timing controller 11 may apply first clock signals CK1 and CK3 of a turn-on level to the first clock lines CKL1 and CKL3, and may apply second clock signals CK2 and CK4 of the turn-on level to the second clock lines CKL2 and CKL4. For example, the clock signals CK1, CK2, CK3, and CK4 of the turn-on level may be sequentially supplied in the order of the first clock line CLK1, the second clock line CKL2, the first clock line CKL3, and the second clock line CKL4. For example, each cycle of the clock signals CK1, CK2, CK3, and CK4 of the turn-on level may be 4 horizontal cycles 4H.

Also, the timing controller 11 may apply the scan start signal FLM of a turn-on level to a scan start line FLML. In this case, the length of the scan start signal FLM of the turn-on level may be set to overlap the first clock signal CK1 of the turn-on level and the second clock signal CK2 of the turn-on level. For example, the length of the scan start signal FLM of the turn-on level may be 2 horizontal cycles.

During the first frame period FP1, the scan driver 13 may alternately apply scan signals SS1, SS2, SS3, SS4, . . . of the turn-on level to the first scan lines SL1, SL3, . . . and the second scan lines SL2, SL4, . . . .

Specifically, a first scan signal SS1 of the turn-on level may be generated in response to the first clock signal CK3 of the turn-on level. Also, a second scan signal SS2 of the turn-on level may be generated in response to the second clock signal CK4 of the turn-on level. Similarly, the first scan signal SS3 of the turn-on level may be generated in response to the first clock signal CK1 of the turn-on level. Also, a second scan signal SS4 of the turn-on level may be generated in response to the second clock signal CK2 of the turn-on level.

The data driver 12 may supply the data voltages to be synchronized with each of the scan signals SS1, SS2, SS3, SS4, . . . of the turn-on level.

Figure 8:
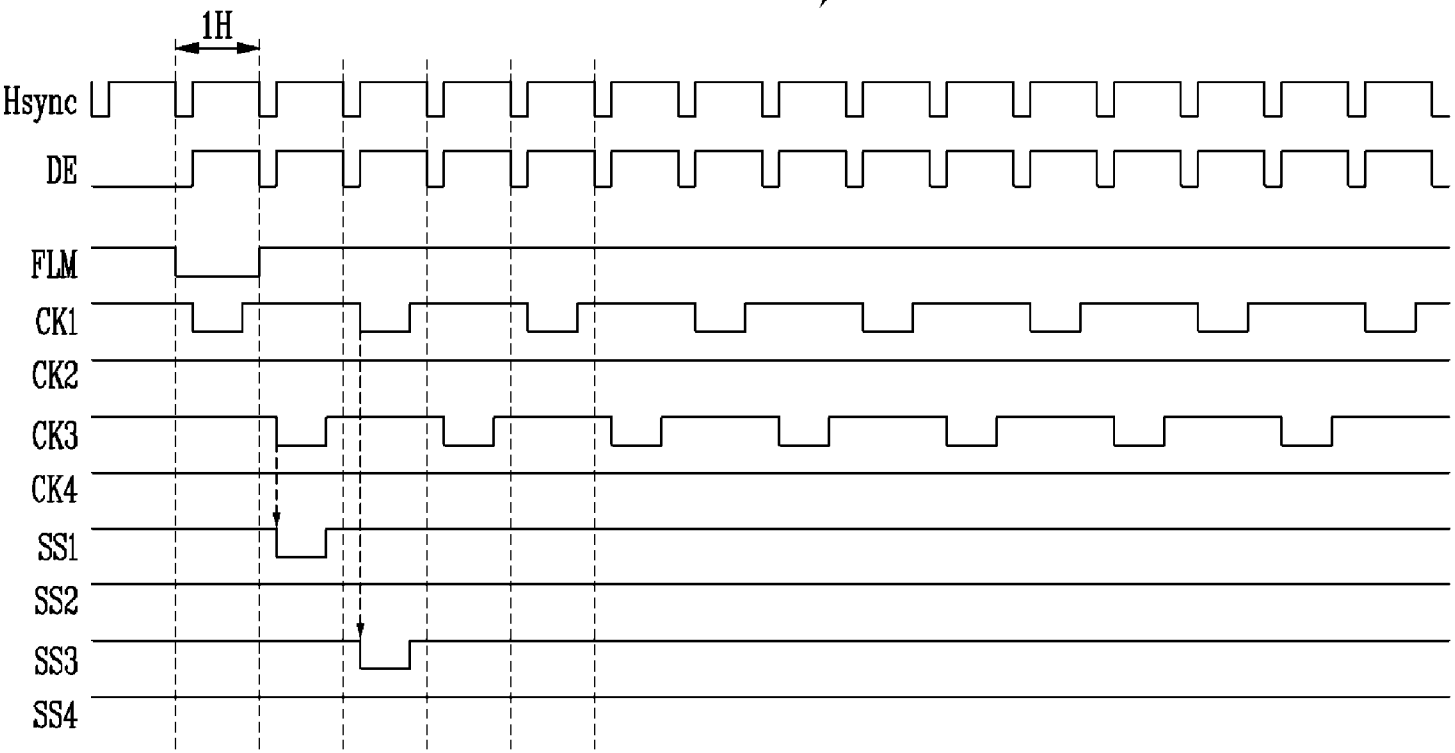
FIG. 8 is a diagram for explaining control signals in a first sub-frame period SFP1 among the second frame period according to an embodiment of the present disclosure.

FIG. 8 is a diagram for explaining control signals in a first sub-frame period SFP1 among the second frame period according to an embodiment of the present disclosure.

Referring to FIG. 8, control signals in the first sub-frame period SFP1 among the second frame period are shown as an example. Specifically, FIG. 8 shows the control signals in a period excluding the blank period BPC among the first sub-frame period SFP1.

During the first sub-frame period SPF1, the timing controller 11 may apply the first clock signals CK1 and CK3 of the turn-on-level to the first clock lines CKL1 and CKL3, and may maintain the second clock signals CK2 and CK4 of a turn-off level in the second clock lines CKL2 and CKL4. In the present embodiment, each cycle in which the first clock signals CK1 and CK3 of the turn-on level are applied to the first clock lines CKL1 and CKL3 in the first sub-frame period SPF1 may be 2 horizontal cycles 2H.

The timing controller 11 may apply the scan start signal FLM of the turn-on level to the scan start line FLML. In this case, the length of the scan start signal FLM of the turn-on level may be set to overlap the first clock signal CK1 of the turn-on level. For example, the length of the scan start signal FLM of the turn-on level may be set to one horizontal cycle.

During the first sub-frame period SFP1, the scan driver 13 may apply first scan signals SS1, SS3, . . . of the turn-on level to the first scan lines SL1, SL3, . . . , and may maintain the second scan signals SS2, SS4, . . . of a turn-off level in the second scan lines SL2, SL4, . . . .

The data driver 12 may supply the data voltages to be synchronized with each of the first scan signals SS1, SS3, . . . of the turn-on level.

Figure 9:
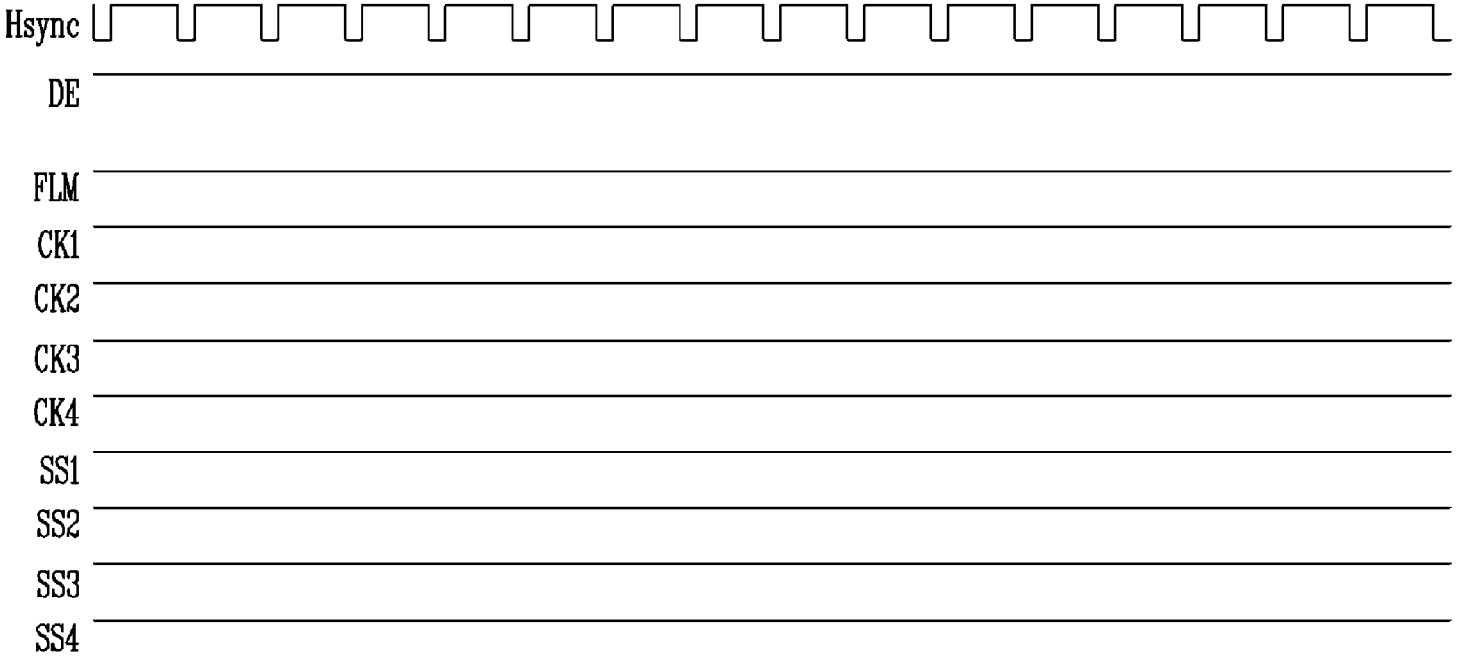
FIG. 9 is a diagram for explaining control signals in a blank period among a second frame period according to an embodiment of the present disclosure.

FIG. 9 is a diagram for explaining control signals in the blank period BPC of the first sub-frame period SFP1 among the second frame period FP2 according to an embodiment of the present disclosure.

Referring to FIG. 9, control signals in the blank period BPC of the first sub-frame period SFP1 among the second frame period FP2 are shown as an example. In the blank period BPC, the clock signals CK1, CK2, CK3, and CK4 of the turn-off level, the scan signals SS1, SS2, SS3, SS4, . . . of the turn-off level, and the scan start signal FLM of a turn-off level may be maintained.

In the blank period BPC, since the clock signals CK1, CK2, CK3, and CK4, the scan signals SS1, SS2, SS3, SS4, . . . , and the scan start signal FLM are maintained in a turned-off state, the data driver 12 may not supply the data voltages.

In addition, as described above, during the blank period BPC, all or at least a part of the data driver 12 (gamma amp, digital logic) may be powered off to reduce power consumption.

Figure 10:
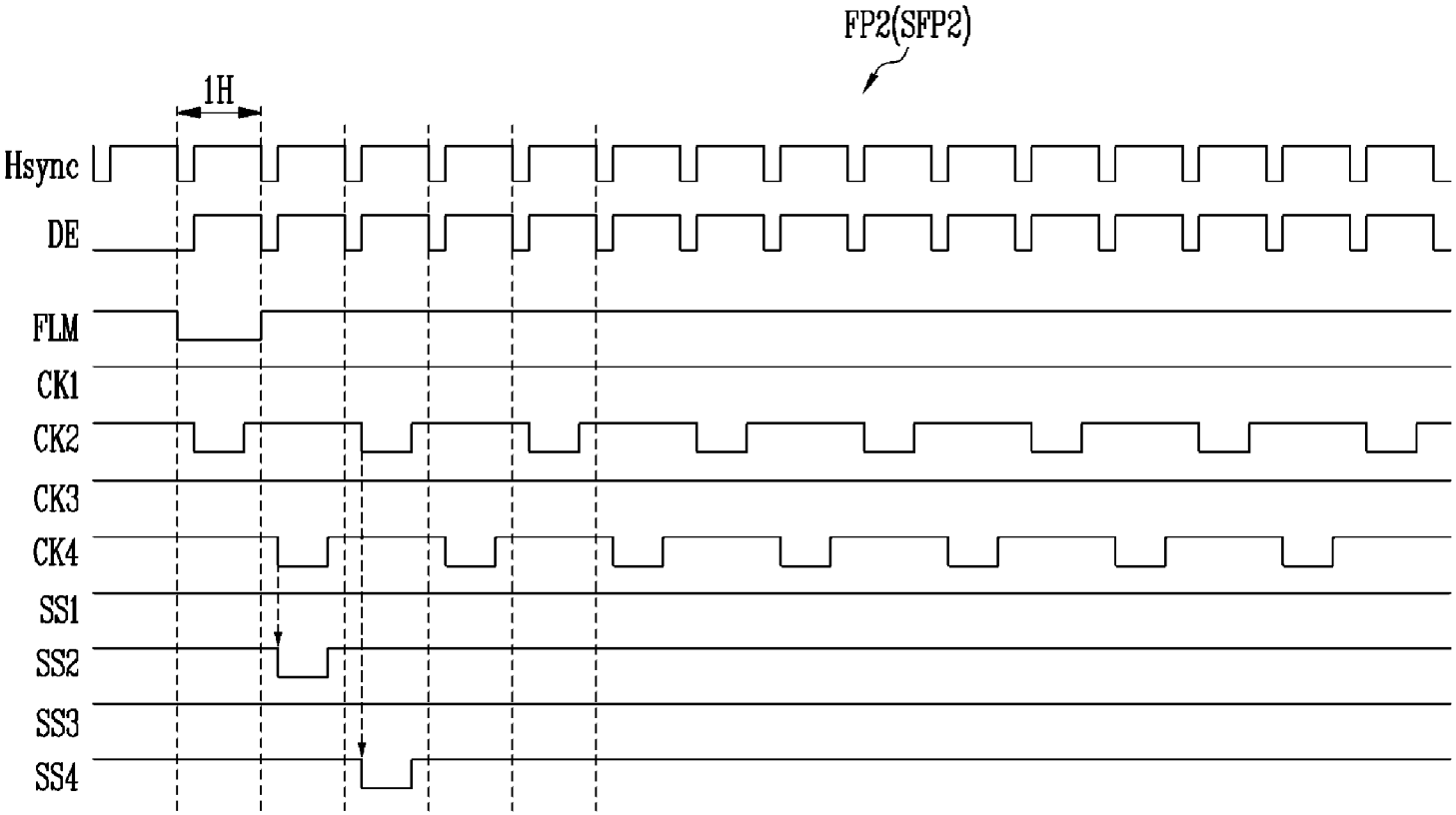
FIG. 10 is a diagram for explaining control signals in a second sub-frame period among the second frame period according to an embodiment of the present disclosure.

FIG. 10 is a diagram for explaining control signals in a second sub-frame period SFP2 among the second frame period FP2 according to an embodiment of the present disclosure.

Referring to FIG. 10, control signals in the second sub-frame period SFP2 among the second frame period FP2 are shown as an example. Specifically, FIG. 10 shows the control signals in a period excluding the blank period BPC among the second sub-frame period SFP2.

During the second sub-frame period SFP2, the second clock signals CK2 and CK4 of the turn-on level may be applied to the second clock lines CKL2 and CKL4, and the first clock signals CK1 and CK3 of the turn-off level may be maintained in the first clock lines CKL1 and CKL3. In an embodiment of the present disclosure, each cycle of the second clock signals CK2 and CK4 of the turn-on level may be 2 horizontal cycles 2H.

Also, the timing controller 11 may apply the scan start signal FLM of the turn-on level to the scan start line FLML. In this case, the length of the scan start signal FLM of the turn-on level may be set to overlap the second clock signal CK2 of the turn-on level. For example, the length of the scan start signal FLM of the turn-on level may be set to one horizontal cycle.

During the second sub-frame period SFP2, the scan driver 13 may apply the second scan signals SS2, SS4, . . . of the turn-on level to the second scan lines SL2, SL4, . . . , and may maintain the first scan signals SS1, SS3, . . . of the turn-off level in the first scan lines SL1, SL3, . . . .

The data driver 12 may supply the data voltages to be synchronized with each of the second scan signals SS2, SS4, . . . of the turn-on level.

Figure 11:
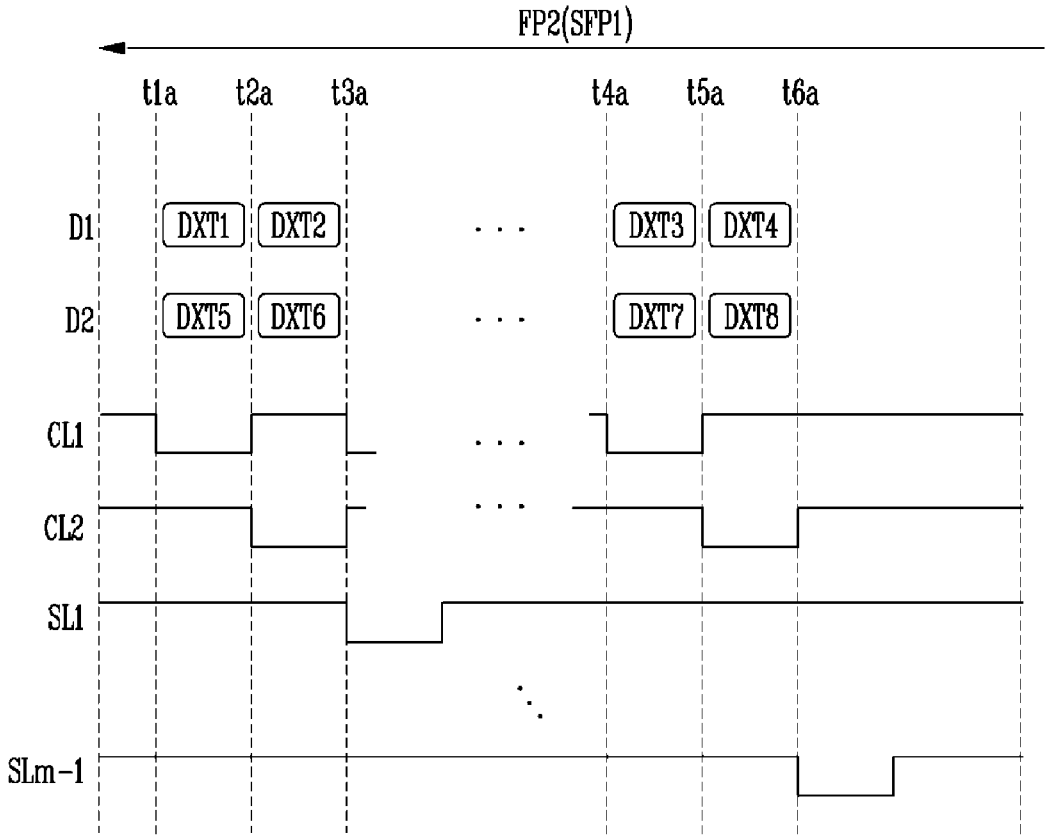
FIG. 11 is a diagram for explaining a driving method of the demultiplexer block unit in a period excluding the blank period among the first sub-frame period according to an embodiment of the present disclosure.

FIG. 11 is a diagram for explaining a driving method of the demultiplexer block unit in a period excluding the blank period among the first sub-frame period according to an embodiment of the present disclosure.

Hereinafter, a driving method of the demultiplexer block unit 16 in the first sub-frame period SFP1 excluding the blank period will be described with reference to FIGS. 2, 6, 8, and 11.

First, at a time point t1*a*, a first control signal of a turn-on level (low level) may be applied to the first control line CL1. Accordingly, the first transistors M11 and M12 may be turned on, a first data line D1 and a second data line DL1 may be connected, and a first data line D2 and a second data line DL3 may be connected. In this case, the data driver 12 may output a first data signal DXT1 to the first data line D1 and may output a first data signal DXT5 to the first data line D2. In this case, the first data signal DXT1 may be charged in the data capacitor Cdata connected to the second data line DL1, and the first data signal DXT5 may be charged in the data capacitor Cdata connected to the second data line DL3. A period from the time point t1*a* to a time point at which the first control signal of a turn-off level is applied may be referred as a first period.

Next, at a time point t2*a*, a second control signal of the turn-on level may be applied to the second control line CL2. Accordingly, the second transistors M21 and M22 may be turned on, the first data line D1 and a second data line DL2 may be connected, and the first data line D2 and a second data line DL4 may be connected. In this case, a second data signal DXT2 may be charged in the data capacitor Cdata connected to the second data line DL2, and a second data signal DXT6 may be charged in the data capacitor Cdata connected to the second data line DL4. A period from the time point t2*a* to a time point at which the second control signal of the turn-off level is applied may be referred to as a second period.

Next, at a time point t3*a*, the first scan signal of the turn-on level may be applied to the first scan line SL1. Accordingly, the first pixels PX1, PX2, PX5, and PX6 may receive the data signals charged in the data capacitor Cdata connected to the second data lines DL1 and DL3 and the data capacitor Cdata connected to the second data lines DL2 and DL4.

Next, at a time point t4*a*, the first control signal of the turn-on level may be applied to the first control line CL1. Accordingly, the first transistors M11 and M12 may be turned on, the first data line D1 and the second data line DL1 may be connected, and the first data line D2 and the second data line DL3 may be connected. In this case, the data capacitor Cdata connected to the second data line DL1 may be charged with a third data signal DXT3, and the data capacitor Cdata connected to the second data line DL3 may be charged with a seventh data signal DXT7. A period from the time point t4*a* to a time point at which the first control signal of the turn-off level is applied may be referred to as a third period.

Next, at a time point t5*a*, the second control signal of the turn-on level may be applied to the second control line CL2. Accordingly, the second transistors M21 and M22 may be turned on, the first data line D1 and the second data line DL2 may be connected, and the first data line D2 and the second data line DL4 may be is connected. In this case, the data capacitor Cdata connected to the second data line DL2 may be charged with a fourth data signal DXT4, and the data capacitor Cdata connected to the second data line DL4 may be charged with an eighth data signal DXT8. A period from the time point t5*a* to a time point at which the second control signal of the turn-off level is applied may be referred to as a fourth period.

Next, at a time point t6*a*, a (m−1)th scan signal of the turn-on level may be applied to the (m−1)th scan line SLm−1, where m may be an even number. Accordingly, the second pixels PX3, PX4, PX7, and PX8 may receive the data signals charged in the data capacitor Cdata connected to the second data lines DL1 and DL3 and the data capacitor Cdata connected to the second data lines DL2 and DL4.

From the time point t6*a*, during the first sub-frame period SFP1 excluding the blank period BPC, a control signal of a turn-off level (high level) may be continuously applied to the first control line CL1. Accordingly, the first transistors M11 and M12 may be turned off, the first data line D1 and the second data line DL1 may not be connected, and the first data line D2 and the second data line DL3 may not be connected. In this case, the data capacitor Cdata connected to the second data line DL1 may be continuously maintained in a state in which the third data signal DXT3 is charged, and the data capacitor Cdata connected to the second data line DL3 may be continuously maintained in a state in which the seventh data signal DXT7 is charged.

Also, the control signal of the turn-off level may be continuously applied to the second control line CL2. Accordingly, the second transistors M21 and M22 may be turned off, the first data line D1 and the second data line DL2 may not be connected, and the first data line D2 and the second data line DL4 may not be connected. In this case, the data capacitor Cdata connected to the second data line DL2 may be continuously maintained in a state in which the fourth data signal DXT4 is charged, and the data capacitor Cdata connected to the second data line DL4 may be continuously maintained in a state in which the fourth data signal DXT8 is charged.

Since the description of the control signal in the second sub-frame period SFP2 excluding the blank period BPC among the second frame period FP2 may be the same as the description in FIG. 11 except that the scan signal is applied to even-numbered scan lines, duplicate descriptions will be omitted.

Figure 12:
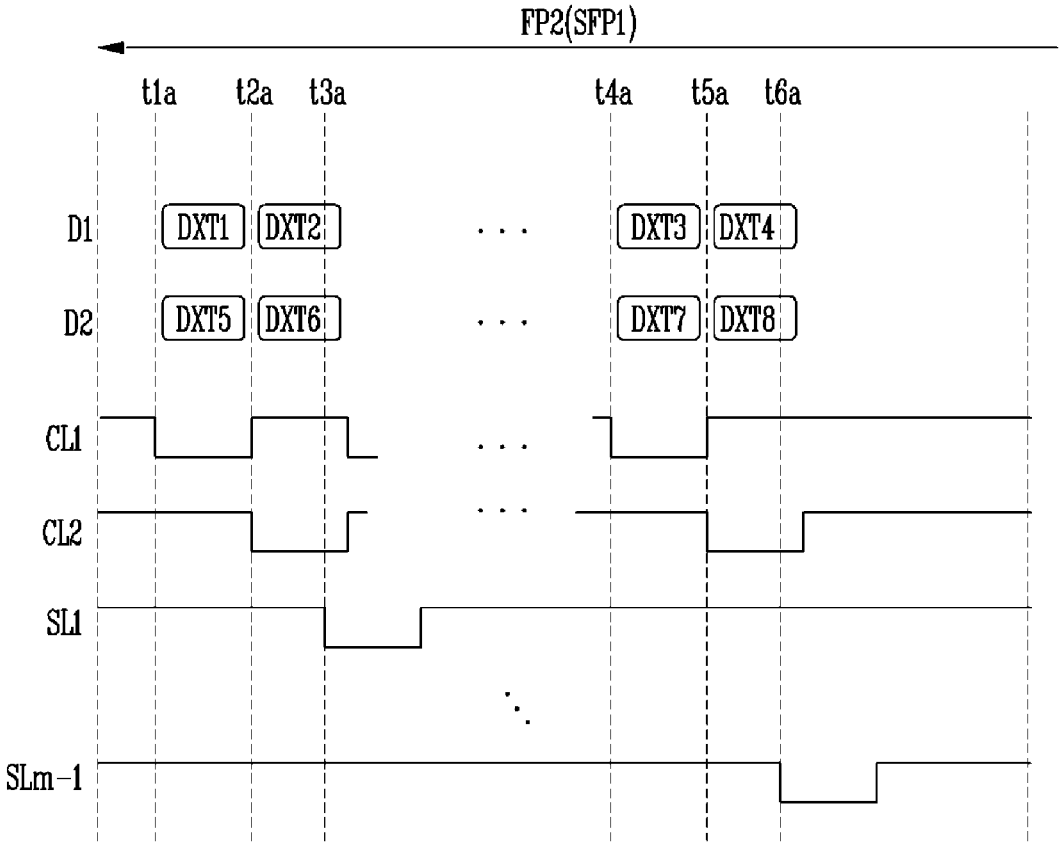
FIG. 12 is a diagram for explaining a driving method of the demultiplexer block unit in a period excluding the blank period among the first sub-frame period according to another embodiment of the present disclosure.

FIG. 12 is a diagram for explaining a driving method of the demultiplexer block unit in a period excluding the blank period among the first sub-frame period according to another embodiment of the present disclosure.

Referring to FIG. 12, the time point t3*a* at which the first scan signal of the turn-on level is applied to the first scan line SL1 may partially overlap a period in which the second control signal of the turn-on level is applied to the second control line CL2. In addition, the time point t6*a* at which the (m−1)th scan signal of the turn-on level is applied to the (m−1)th scan line SLm−1 may partially overlap the period in which the second control signal of the turn-on level is applied to the second control line CL2.

Except the time point in which the scan signal is applied to the scan lines of FIG. 12, since the driving method of the demultiplexer block unit in the period excluding the blank period among the first sub-frame period may be the same as the description in FIG. 11, duplicate descriptions will be omitted.

Figure 13:
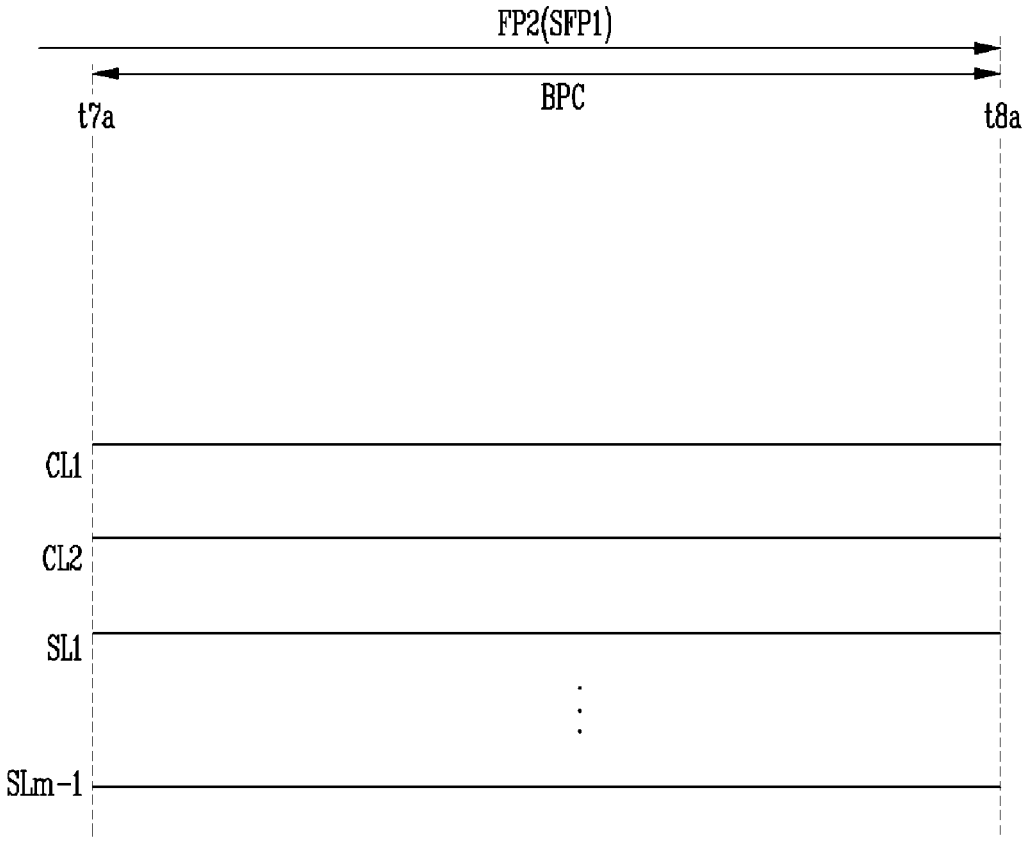
FIG. 13 is a diagram for explaining a driving method of the demultiplexer block unit in the blank period among the first sub-frame period according to an embodiment of the present disclosure.

FIG. 13 is a diagram for explaining a driving method of the demultiplexer block unit in the blank period among the first sub-frame period according to an embodiment of the present disclosure.

Hereinafter, a driving method of the demultiplexer block unit 16 in the blank period among the first sub-frame period will be described with reference to FIGS. 2, 6, 9, and 13.

In the blank period BPC (from a time point t7*a* to a time point t8*a*) among the first sub-frame period SFP1, the first control signal of the turn-off level (high level) may be continuously applied to the first control line CL1.

Accordingly, the data capacitor Cdata connected to the second data line DL1 may be continuously maintained in a state in which the third data signal DXT3 is charged from the time point t6*a* of FIG. 12 to the time point t8*a* of FIG. 13, and the data capacitor Cdata connected to the second data line DL3 may be continuously maintained in a state in which the third data signal DXT7 is charged.

In addition, in the blank period BPC (from the time point t7*a* to the time point t8*a*) among the first sub-frame period SFP, a (m−1)th control signal of the turn-off level (high level) may be continuously applied to a (m−1)th control line CLm−1.

Accordingly, the data capacitor Cdata connected to the second data line DL2 may be continuously maintained in a state in which the fourth data signal DXT4 is charged from the time point t6*a* of FIG. 12 to the time point t8*a* of FIG. 13, and the data capacitor Cdata connected to the second data line DL4 may be continuously maintained in a state in which the fourth data signal DXT8 is charged.

According to an embodiment of the present disclosure, in the blank period BPC among the first sub-frame period SFP1, the control signals of the turn-off level (high level) may be continuously applied to odd-numbered control lines CL1, CL3, . . . , and CLm−1. Third data signals DXT3 and DTX7 and fourth data signals DXT4 and DXT8 charged in the data capacitor Cdata in the first sub-frame period SFP1 excluding the blank period BPC may not be output to the second data lines DL1, DL2, DL3, and DL4 in the blank period BPC, and may be continuously maintained while being charged in the data capacitor Cdata.

According to an embodiment, the control signal (the first control signal and the second control signal) of the turn-off level (high level) may be applied to the first control line CL1 and the second control line CL2 in the blank period BPC. By maintaining the data capacitor Cdata in a charged state, flicker that may occur when switching from the first sub-frame period SFP1 excluding the blank period BPC to the blank period BPC can be reduced.

In an embodiment of the present disclosure, since the description of the control signals in the blank period BPC of the second sub-frame period SFP2 among the second frame period FP2 may be the same as the description of the control signals in the blank period BPC of the first sub-frame period SFP1 among the second frame period FP2 of FIG. 13, duplicate descriptions will be omitted.

Figure 14:
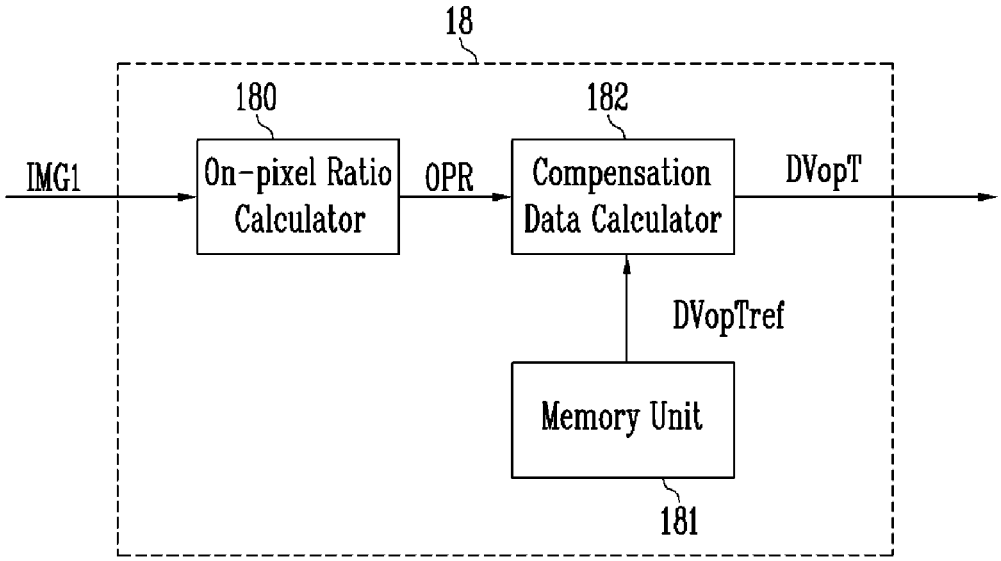
FIG. 14 is a diagram for explaining a compensator according to an embodiment of the present disclosure.

FIG. 14 is a diagram for explaining a compensator according to an embodiment of the present disclosure.

The compensator 18 according to an embodiment may include an on-pixel ratio calculator 180, a memory unit 181, and a compensation data calculator 182. That is, the on-pixel ratio calculator 180 is connected to the compensator data calculator 182, and the memory unit 181 is connected to the compensator data calculator 182.

The on-pixel ratio calculator 180 included in the compensator 18 may receive input grayscale values IMG1 for pixels PXij in a sub-frame period excluding the blank period BPC of FIG. 6. The on-pixel ratio calculator 180 may calculate an on-pixel ratio OPR using the received input grayscale values IMG1. In addition, the compensator 18 may transfer on-pixel ratio data including the calculated on-pixel ratio OPR to the compensation data calculator 182. Here, the on-pixel ratio may mean a ratio of the number of pixels to which power is supplied to operate among all the pixels PXij included in the pixel unit 14.

The memory unit 181 may store in advance a reference compensation data voltage DVopTref corresponding to each on-pixel ratio OPR calculated by the on-pixel ratio calculator 180. For example, the memory unit 181 may store the reference compensation data voltage DVopTref (or compensation data) corresponding to the on-pixel ratio OPR of a predetermined section. In this case, the reference compensation data voltage DVopTref may be set differently for each section. Here, the reference compensation data voltage DVopTref may be predetermined so that the flicker can be reduced.

The compensation data calculator 182 may calculate compensation data corresponding to the on-pixel ratio data transferred from the compensator 18 using the reference compensation data voltage DVopTref stored in the memory unit 181.

Before the blank period BPC of FIG. 6 starts, the compensation data calculator 182 may control the timing controller 11 using the compensation data including a calculated compensation data voltage DVopT.

Specifically, the compensation data generated by the compensator 18 may be supplied to the data driver 12 via the timing controller 11. The data driver 12 may supply a compensation data signal corresponding to the compensation data to the first data lines D1 to Dn during the blank period among one frame period. The compensation data signal supplied to the first data lines D1 to Dn may be supplied to the second data lines DL1 to DLp via the demultiplexer 160. Accordingly, a voltage corresponding to the compensation data signal may be stored in the data capacitor Cdata.

Figure 15:
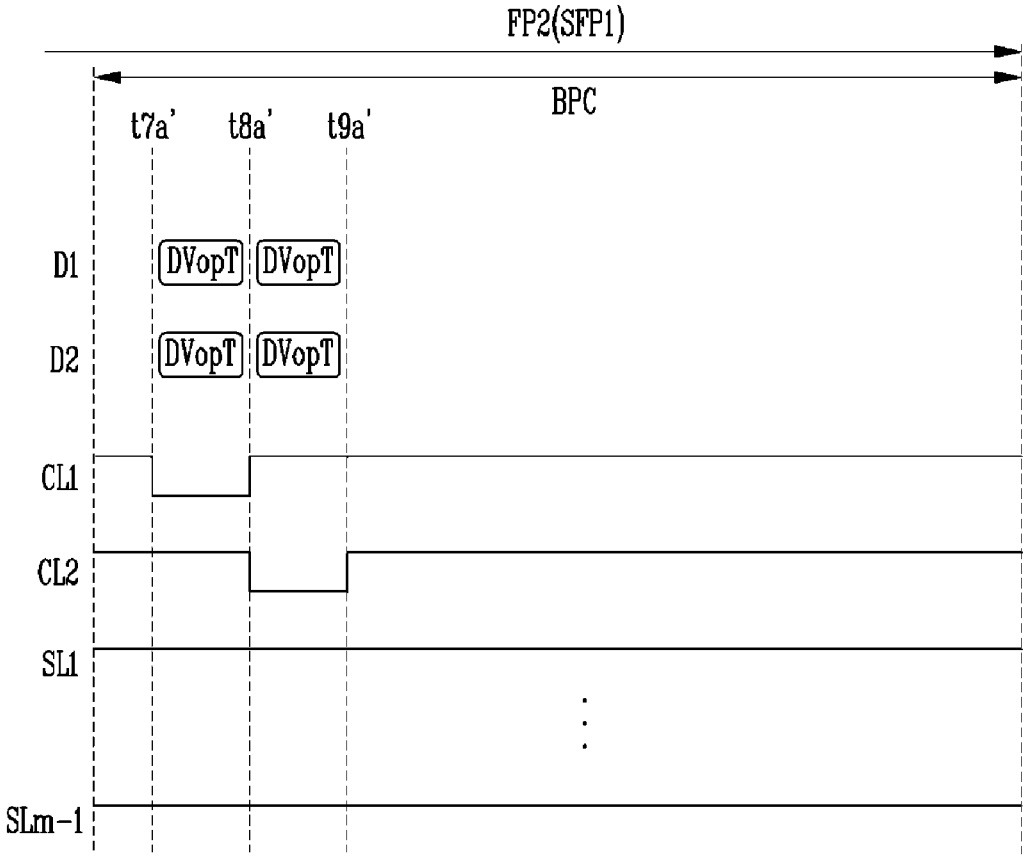
FIG. 15 is a diagram for explaining a driving method of the demultiplexer block unit in the blank period among the first sub-frame period according to another embodiment of the present disclosure.

FIG. 15 is a diagram for explaining a driving method of the demultiplexer block unit in the blank period among the first sub-frame period according to another embodiment of the present disclosure.

Hereinafter, a driving method of the demultiplexer block unit using the on-pixel ratio in the blank period among the first sub-frame period will be described with reference to FIGS. 1, 6, 9, 14, and 15.

First, the compensator 18 may generate the compensation data corresponding to the on-pixel ratio calculated in the first sub-frame period SFP1 excluding the blank period BPC of FIG. 6. The timing controller 11 may control the data driver 12 according to the generated compensation data. Specifically, the data driver 12 may output the compensation data signal corresponding to the compensation data voltage DVopT generated by the compensator 18 to the first data lines D1 to Dn in the blank period BPC.

At a time point t7*a*', the first control signal of the turn-on level (low level) may be applied to the first control line CL1. Accordingly, the first transistors M11 and M12 may be turned on, the first data line D1 and the second data line DL1 may be connected, and the first data line D2 and the second data line DL3 may be connected. In this case, the data driver 12 may output the compensation data signal corresponding to the compensation data voltage DVopT to the first data line D1, and may output the compensation data signal corresponding to the compensation data voltage DVopT to the first data line D2. Accordingly, the compensation data voltage DVopT may be charged in the data capacitor Cdata connected to the second data line DL1, and the compensation data voltage DVopT may be charged in the data capacitor Cdata connected to the second data line DL3. A period from the time point t7*a*' to a time point at which the first control signal of the turn-off level is applied may be referred to as a fifth period.

Next, at a time point t8*a*', the second control signal of the turn-on level may be applied to the second control line CL2. Accordingly, the second transistors M21 and M22 may be turned on, the first data line D1 and the second data line DL2 may be connected, and the first data line D2 and the second data line DL4 may be connected. In this case, the compensation data voltage DVopT may be charged in the data capacitor Cdata connected to the second data line DL2, and the compensation data voltage DVopT may be charged in the data capacitor Cdata connected to the second data line DL4. A period from the time point t8*a*' to a time point at which the second control signal of the turn-off level is applied may be referred to as a sixth period.

However, in the blank period BPC according to the embodiment of FIG. 15, the scan signal may not be applied to odd-numbered scan lines SL1, SL3, . . . , and SLm−1. Therefore, the first pixels PX1, PX2, PX5, and PX6 and the second pixels PX3, PX4, PX7, and PX8 may not receive compensation data signals charged in the data capacitor Cdata.

Accordingly, the data capacitor Cdata connected to the second data line DL1 may be continuously maintained in a state in which the compensation data voltage DVopT is charged, and the data capacitor Cdata connected to the second data line DL3 may be continuously maintained in a state in which the compensation data voltage DVopT is charged.

In addition, the data capacitor Cdata connected to the second data line DL2 may be continuously maintained in a state in which the compensation data voltage DVopT is charged, and the data capacitor Cdata connected to the second data line DL4 may be continuously maintained in a state in which the compensation data voltage DVopT is charged.

According to another embodiment of the present disclosure, in the blank period BPC among the first sub-frame period SFP1, the first control signal of the turn-on level (low level) may be applied once to the first control line CL1 and the second control signal of the turn-on level (low level) may be applied once to the second control line CL2. Accordingly, the compensation data voltage DVopT charged in the data capacitor Cdata in the fifth and sixth periods may not be output to the second data lines DL1, DL2, DL3, and DL4, and may be continuously maintained while being charged in the data capacitor Cdata.

According to an embodiment, in the first frame period SFP excluding the blank period BPC, the on-pixel ratio may be calculated using the data signal stored in the data capacitor Cdata, and the compensation data voltage DVopT corresponding thereto may be continuously maintained while being charged in the data capacitor Cdata. Therefore, the flicker that may occur when switching from the first sub-frame period SFP1 excluding the blank period BPC to the blank period BPC can be reduced.

Since the description of the blank period BPC of the second sub-frame period SFP2 among the second frame period FP2 according to an embodiment of the present disclosure may be the same as the description of the blank period BPC of the first sub-frame period SFP1 among the second frame period FP2 of FIG. 15, duplicate descriptions will be omitted.

The display device and the driving method thereof according to the present disclosure may have an effect of preventing the visibility of flicker when the display frequency is switched from the high frequency to the low frequency.

Although the embodiments have been described with reference to the accompanying drawings, those of ordinary skill in the art to which the embodiments belongs can understand that the embodiments can be implemented in other specific forms without changing the technical idea or essential features thereof. Therefore, it should be understood that the embodiments described above are illustrative in all respects and not limiting.

What is claimed is:

1. A display device comprising:

a demultiplexer connected to a first data line and configured to transfer a data signal from the first data line to a plurality of second data lines during a data writing period of one frame;

a compensator calculating an on-pixel ratio (OPR) using input data in the one frame and configured to generate compensation data corresponding to a calculated OPR; and a data driver configured to supply the data signal to the first data line through the input data during the data writing period, and supply a compensation data signal to the first data line through the compensation data in a blank period of the one frame, wherein the demultiplexer supplies the compensation data signal from the first data line to a second data line during the blank period.

2. The display device of claim 1, wherein the demultiplexer includes a plurality of transistors connected to the first data line, and the plurality of transistors are turned on when a control signal is supplied from a demultiplexer controller.

3. The display device of claim 2, wherein the demultiplexer controller supplies the control signal so that the plurality of transistors are repeatedly turned on during the data writing period, and supplies the control signal so that the compensation data signal is supplied to the second data line, and the plurality of transistors are turned on at least once during the blank period.

4. The display device of claim 3, wherein the compensator includes:

an on-pixel ratio calculator calculating the OPR;

a compensation data calculator calculating the compensation data corresponding to the OPR; and a memory unit storing the compensation data.

5. The display device of claim 4, wherein the compensation data signal is stored in a data capacitor connected to each of the second data lines during the data writing period.

6. The display device of claim 5, wherein the compensation data signal stored in the data capacitor is supplied to the second data line during the blank period.

7. The display device of claim 6, further comprising:

a scan driver connected to a plurality of scan lines and configured to supply a scan signal to the plurality of scan lines during the data writing period.

8. The display device of claim 7, wherein a period in which the scan signal is supplied overlaps a part of a period in which the data signal is supplied.

9. A display device comprising: a demultiplexer connected to a first data line and configured to transfer a data signal from the first data line to a plurality of second data lines in response to a control signal supplied during a data writing period of one frame; a data driver configured to supply the data signal to the first data line during the data writing period; and a demultiplexer controller configured to supply the control signal for controlling a plurality of transistors included in the demultiplexer, wherein the demultiplexer controller supplies the control signal of a high level for turning off the plurality of transistors during a blank period of the one frame, and wherein during the blank period, last data transferred to a second data line during the data writing period is stored in a data capacitor connected to each of the second data lines; wherein the blank period is a period in which the data signal is not transferred to the second data line.

10. The display device of claim 9, wherein the plurality of transistors are connected to the first data line and the plurality of second data lines, and are turned on when the control signal of a low level is supplied from the demultiplexer controller.

11. The display device of claim 10, wherein the demultiplexer controller supplies the control signal so that the plurality of transistors are repeatedly turned on during the data writing period.

12. The display device of claim 11, further comprising: a scan driver connected to a plurality of scan lines and supplying a scan signal to the plurality of scan lines during the data writing period.

13. The display device of claim 12, wherein a period in which the scan signal is supplied overlaps a part of a period in which the data signal is supplied.

14. A driving method of a display device including a demultiplexer, a compensator, and a data driver, comprising steps of:

transferring a data signal from a first data line to a plurality of second data lines during a data writing period of one frame by the demultiplexer connected to the first data line;

calculating an on-pixel ratio (OPR) through input data in the one frame and configured to generate compensation data corresponding to a calculated OPR by the compensator; and supplying the data signal to the first data line through the input data during the data writing period and configured to supply a compensation data signal to the first data line using the compensation data during a blank period of the one frame by the data driver, wherein the demultiplexer supplies the compensation data signal from the first data line to a second data line during the blank period.

15. The driving method of claim 14, wherein the demultiplexer includes a plurality of transistors connected to the first data line, and wherein the transferring the data signal from the first data line to the plurality of second data lines is accomplished by turning on the plurality of transistors when a control signal is supplied from a demultiplexer controller.

16. The driving method of claim 15, wherein the turning on the plurality of transistors when the control signal is supplied includes steps of:

supplying the control signal so that the plurality of transistors are repeatedly turned on by the demultiplexer controller during the data writing period; and supplying the control signal so that the compensation data signal is supplied to the second data line and the plurality of transistors are turned on at least once during the blank period.

* * * * *